US007740321B2

(12) United States Patent
Brill et al.

(10) Patent No.: US 7,740,321 B2
(45) Date of Patent: Jun. 22, 2010

(54) SUSPENDED PIXELATED SEATING STRUCTURE

(75) Inventors: Ryan S. Brill, Allendale, MI (US); Douglas M. VanDeRiet, Holland, MI (US); John F. Aldrich, Grandville, MI (US); Christopher C. Hill, Zeeland, MI (US); Andrew J. Kurrasch, Saugatuck, MI (US); James D. Slagh, Holland, MI (US); Matthew Parkinson, State College, PA (US); Matthew P. Reed, Ann Arbor, MI (US); Jeffrey A. Weber, Golden Valley, MN (US); Timothy P. Coffield, Grand Rapids, MI (US)

(73) Assignee: Herman Miller, Inc., Zeeland, MI (US)

( * ) Notice: Subject to any disclaimer, the term of this patent is extended or adjusted under 35 U.S.C. 154(b) by 338 days.

(21) Appl. No.: 11/433,891

(22) Filed: May 12, 2006

(65) Prior Publication Data

US 2007/0262634 A1 Nov. 15, 2007

(51) Int. Cl.
*A47C 7/35* (2006.01)
*A47C 7/02* (2006.01)

(52) U.S. Cl. ..... 297/452.49; 297/284.3; 297/452.62

(58) Field of Classification Search ..... 297/452.49, 297/452.56, 452.63, 284.3; 5/719, 247, 255
See application file for complete search history.

(56) References Cited

U.S. PATENT DOCUMENTS

| | | | |
|---|---|---|---|
| 1,982,516 | A | 11/1934 | Holmested |
| 2,233,592 | A | 3/1941 | Dunajeff |
| 2,433,012 | A | 12/1947 | Zalicovitz |
| 2,549,902 | A | 4/1951 | Hibbard et al. |
| 2,897,879 | A | 8/1959 | Brown et al. |
| 3,081,129 | A | 3/1963 | Ridder |
| 3,126,554 | A | 3/1964 | Janapol |
| 3,174,741 | A | 3/1965 | Wolff |
| 3,198,578 | A | 8/1965 | Geoffrey et al. |
| 3,233,885 | A | 2/1966 | Propst |

(Continued)

FOREIGN PATENT DOCUMENTS

| | | | |
|---|---|---|---|
| BE | 628 357 | A | 5/1963 |

(Continued)

OTHER PUBLICATIONS

Sitting Machine Photograph, Circa 1987-1988, 1 pg.

(Continued)

*Primary Examiner*—David Dunn
*Assistant Examiner*—James Alex
(74) *Attorney, Agent, or Firm*—Brinks Hofer Gilson & Lione

(57) ABSTRACT

A suspended pixelated seating structure provides ergonomic, adaptable seating support. The suspended pixelated seating structure includes multiple cooperative layers to maximize global comfort and support while enhancing adaptation to localized variations in a load, such as in the load applied when a person sits in a chair. The cooperative layers each use independent elements such as pixels, springs, support rails, and other elements to provide this adaptable comfort and support. The suspended pixelated seating structure also uses aligned material to provide a flexible yet durable suspended seating structure. Accordingly, the suspended pixelated seating structure provides maximum comfort for a wide range of body shapes and sizes.

34 Claims, 27 Drawing Sheets

U.S. PATENT DOCUMENTS 3,242,512 A 3/1966 Beckman
3,251,077 A 5/1966 Beckman
3,255,470 A 6/1966 Knittel
3,261,037 A 7/1966 Cermak et al.
3,262,137 A 7/1966 Beckman et al.
3,262,138 A 7/1966 Knittel
3,263,247 A 8/1966 Knittel et al.
3,276,048 A 10/1966 Beckman
3,280,410 A 10/1966 Propst et al.
3,340,548 A 9/1967 Janapol
3,393,012 A 7/1968 Chancellor, Jr.
3,398,012 A 8/1968 E. Parkes et al.
3,559,978 A 2/1971 Molt
3,591,876 A 7/1971 Swindlehurst
3,633,228 A 1/1972 Zysman
3,681,797 A 8/1972 Messner
3,767,261 A 10/1973 Rowland
3,774,967 A 11/1973 Rowland
3,790,150 A 2/1974 Lippert
3,806,576 A 4/1974 Richardson et al.
3,843,477 A 10/1974 Rowland
3,889,302 A 6/1975 Ketterer et al.
3,940,811 A 3/1976 Tomikawa et al.
3,999,234 A 12/1976 Regan
4,033,567 A 7/1977 Lipfert
4,036,526 A 7/1977 Baechle et al.
4,190,914 A 3/1980 Diallo
4,283,864 A 8/1981 Lipfert
4,286,344 A 9/1981 Ikeda
4,367,897 A 1/1983 Cousins
4,383,342 A 5/1983 Forster
4,399,574 A 8/1983 Shuman
4,415,147 A 11/1983 Biscoe et al.
4,509,510 A 4/1985 Hook
4,559,656 A 12/1985 Foster
4,605,582 A 8/1986 Sias et al.
4,644,593 A 2/1987 O'Brien
4,673,605 A 6/1987 Sias et al.
4,686,724 A 8/1987 Bedford
4,713,854 A 12/1987 Graebe
4,744,351 A 5/1988 Grundei et al.
4,809,374 A 3/1989 Saviez
4,826,249 A 5/1989 Bradbury
4,890,235 A 12/1989 Reger et al.
4,972,351 A 11/1990 Reger et al.
4,980,936 A 1/1991 Frickland et al.
5,025,519 A 6/1991 Spann et al.
5,105,488 A 4/1992 Hutchinson et al.
5,153,956 A 10/1992 Nold
5,163,196 A 11/1992 Graebe et al.
5,165,125 A 11/1992 Callaway
5,239,715 A 8/1993 Wagner
5,316,375 A 5/1994 Breen
5,328,245 A 7/1994 Marks et al.
5,426,799 A 6/1995 Ottiger et al.
5,452,488 A 9/1995 Reinhardt
5,459,896 A 10/1995 Raburn et al.
D368,399 S 4/1996 Buffon
5,502,855 A 4/1996 Graebe
5,533,220 A 7/1996 Sebag et al.
5,558,314 A 9/1996 Weinstein
5,558,398 A 9/1996 Santos
5,572,804 A 11/1996 Skaja et al.
5,588,165 A 12/1996 Fromme
5,615,869 A 4/1997 Phillips et al.
5,624,161 A 4/1997 Sorimachi et al.
5,628,079 A 5/1997 Kizemchuk et al.
5,632,473 A 5/1997 Dias Magalhaes Queiroz
5,638,565 A 6/1997 Pekar
5,720,471 A 2/1998 Constantinescu et al.
5,747,140 A 5/1998 Heerklotz
5,785,303 A 7/1998 Kutschi
5,787,533 A * 8/1998 Fromme ..... 5/719
5,820,573 A 10/1998 Ramos
5,975,641 A 11/1999 Delesie
5,976,451 A 11/1999 Skaja et al.
6,029,962 A 2/2000 Shorten et al.
6,052,852 A 4/2000 Huang
6,059,368 A 5/2000 Stumpf et al.
6,098,313 A 8/2000 Skaja
6,101,651 A 8/2000 Tang
6,113,082 A 9/2000 Fujino
6,134,729 A 10/2000 Quintile et al.
6,170,808 B1 1/2001 Kutschi
6,217,121 B1 4/2001 Mollet
6,343,394 B1 2/2002 Gandolfi
6,353,953 B1 3/2002 Tanaka et al.
6,382,603 B1 5/2002 Monson et al.
6,406,009 B1 6/2002 Constantinescu et al.
6,425,153 B1 7/2002 Reswick
6,427,990 B1 8/2002 Hartmann
6,477,727 B1 11/2002 Fromme
6,540,950 B1 4/2003 Coffield
6,546,578 B1 4/2003 Steinmeier
6,598,251 B2 7/2003 Habboub et al.
6,663,178 B2 12/2003 Fourrey et al.
D486,027 S 2/2004 Baxter et al.
6,726,285 B2 4/2004 Caruso et al.
6,901,617 B2 6/2005 Sprouse, II et al.
6,986,182 B2 * 1/2006 Mossbeck ..... 5/727
7,356,859 B2 * 4/2008 McCraw ..... 5/247
2002/0106479 A1 8/2002 Coffield et al.
2002/0117885 A1 8/2002 Barile, Jr. et al.
2003/0001424 A1 1/2003 Mundell et al.
2004/0245839 A1 12/2004 Bodnar et al.
2004/0245840 A1 12/2004 Tubergen et al.
2004/0245841 A1 12/2004 Peterson et al.
2005/0116526 A1 6/2005 VanDeRiet et al.
2005/0279591 A1 12/2005 Coffield et al.
2006/0267258 A1 11/2006 Coffield et al.
2006/0286359 A1 12/2006 Coffield et al.
2007/0246873 A1 10/2007 VanDeRiet et al.
2007/0262634 A1 11/2007 Brill et al.
2008/0217977 A1 9/2008 Aldrich et al.
2009/0085388 A1 4/2009 Parker et al.

FOREIGN PATENT DOCUMENTS

DE 93 12 478.3 U1 10/1993
DE 297 12 721 U1 10/1998
EP 0 086 578 A2 8/1983
EP 0 111 898 B1 11/1986
EP 0228350 A2 7/1987
EP 0 734 666 B1 1/2000
EP 1034726 A1 9/2000
EP 1046361 A1 10/2000
EP 1057433 A1 12/2000
EP 1099397 A1 5/2001
EP 0996349 B1 11/2001
EP 0895739 B1 9/2002
EP 1 121 880 B1 11/2004
EP 1 859 768 A 11/2007
GB 2 088 206 A 6/1982
JP 2000/51010 2/2000
WO WO 99/03379 1/1999
WO WO 99/22160 5/1999
WO WO 01/15572 A1 3/2001
WO WO 2005/041719 A2 5/2005
WO WO 2007/131370 11/2007

OTHER PUBLICATIONS

Lattoflex Bettsystem, Winx 100, Jan. 2001, 16 pages.
Lattoflex Bettsystem, Winx 200, Jan. 2001, 20 pages.
Lattoflex Bettsystem, Winx 300, Jan. 2000, 20 pages.

Frolic website pages, printed Feb. 28, 2002, 52 pages.
"SKYDEX Smarter Cushioning," SKYDEX Technologies, Inc., http://www.skydex.com/technology.htm, 2002, 1 page.
Combined Search Report & Examination Report dated Feb. 19, 2008, for corresponding United Kingdom Patent Application No. 0801934.1, 3 pages.
International Preliminary Report on Patentability dated Mar. 3, 2009, for corresponding PCT International Application No. PCT/US2004/034933, 8 pages.
International Preliminary Report on Patentability dated Nov. 17, 2008, for corresponding PCT International Application No. PCT/US2007/010625, 10 pages.
International Search Report and Written Opinion of the International Searching Authority dated Aug. 11, 2008, for corresponding PCT International Application No. PCT/US2007/010625, 13 pages.
International Search Report and Written Opinion of the International Searching Authority dated May 13, 2008, for corresponding PCT International Application No. PCT/US2004/034933, 12 pages.
International Search Report and Written Opinion of the International Searching Authority dated Oct. 6, 2009, for corresponding PCT International Application No. PCT/US2009/051221, 13 pages.
Nebel, Antonio et al., The Miracles of Science, Presentation Slides, Sep., 2003, 44 pages.
Office Action dated Jan. 14, 2009 for corresponding Canadian Patent Application No. 2,542,978, 3 pages.
Office Action dated Jan. 25, 2008 for corresponding Canadian Patent Application No. 2,542,978, 3 pages.
Office Action dated Mar. 7, 2007 for corresponding United Kingdom application No. 0608532.8, 3 pages.
Office Action dated Oct. 9, 2007 for corresponding United Kingdom application No. 0608532.8, 1 page.
Office Action dated Jun. 8, 2009 for corresponding U.S. Appl. No. 11/645,234, 13 pages.
Office Action dated Nov. 3, 2006 for corresponding U.S. Appl. No. 10/972,153, 7 pages.
Office Action dated May 8, 2007 for corresponding U.S. Appl. No. 10/972,153, 8 pages.
Office Action dated May 2, 2008 for corresponding U.S. Appl. No. 10/972,153, 8 pages.
Office Action dated Nov. 21, 2008 for corresponding U.S. Appl. No. 10/972,153, 7 pages.
Photo, "interlübke" Support System, 1 page, date unknown.
Photo, "Ubila," 1 page, date unknown.
U.S. Patent and Trademark Office Action dated Jun. 8, 2009, for U.S. Appl. No. 11/645,234, 13 pages.
Office Action dated Dec. 30, 2009 for U.S. Appl. No. 11/645,234, 12 pages.

* cited by examiner

SUSPENDED PIXELATED SEATING STRUCTURE

BACKGROUND OF THE INVENTION

1. Technical Field

The invention relates to load support structures. In particular, the invention relates to suspended pixelated seating structures.

2. Related Art

Most people spend a significant amount of time sitting each day. Inadequate support can result in reduced productivity, body fatigue, or even adverse health conditions such as chronic back pain. Extensive resources have been devoted to research and development of chairs, benches, mattresses, sofas, and other load support structures.

In the past, for example, chairs have encompassed designs ranging from cushions to more complex combinations of individual load bearing elements. These past designs have improved the general comfort level provided by seating structures, including providing form fitting comfort for a user's general body shape. Some discomfort, however, may still arise even from the improved seating structures. For example, a seating structure, though tuned to conform to a wide variety of general body shapes, may resist conforming to a protruding wallet, butt bone, or other local irregularity in body shape. This may result in discomfort as the seating structure presses the wallet or other body shape irregularity up into the seated person's backside.

Thus, while some progress has been made in providing comfortable seating structures, there remains a need for improved seating structures tuned to fit and conform to a wide range of body shapes and sizes.

SUMMARY

A suspended pixelated seating structure provides comfortable and durable seating support. The suspended pixelated seating structure includes multiple cooperative layers to maximize global comfort and support while enhancing adaptation to localized irregularities in body shape. The cooperative layers each use independent elements such as pixels, springs, support rails, and other elements to provide significant comfort for localized protrusions or irregularities, as well as for general or more uniform characteristics, in an applied load, such as that applied when a person sits in a chair. The suspended pixelated seating structure also uses aligned material to provide a flexible yet durable seating structure. In this manner each portion of the suspended pixelated seating structure may independently conform to and support non-uniform shapes, sizes, weights, and other load characteristics.

The suspended pixelated seating structure may include a macro compliance layer, a micro compliance layer, and a load support layer. The macro compliance layer provides controlled deflection of the seating structure upon application of a load. The macro compliance layer includes multiple primary support rails which also support the micro compliance layer. The macro compliance layer may also include multiple tensile expansion members which may include an aligned material to facilitate deflection of the macro compliance layer when a load is imposed. The macro compliance layer further includes multiple expansion control strands connected between the multiple primary support rails. As the tensile expansion members facilitate deflection of the macro compliance layer, the expansion control strands may inhibit excess deflection. Accordingly, the suspended pixelated seating structure is tuned to be highly sensitive and conform to very light loads, while providing controlled deflection for heavier loads.

The micro compliance layer facilitates added and independent deflection upon application of a load to the suspended pixelated seating structure. The micro compliance layer includes multiple spring elements supported by the multiple primary support rails. The multiple spring elements each include a top and a deflection member. Each of the multiple spring elements may independently deflect under a load based upon a variety of factors, including the spring type, relative position of the spring element within the suspended pixelated seating structure, spring material, spring dimensions, connection type to other elements of the suspended pixelated seating structure, and other factors.

The load support layer may be the layer upon which a load is applied. The load support layer includes multiple pixels positioned above the multiple spring elements. The multiple pixels contact with the tops of the multiple spring elements. Like the multiple spring elements, the multiple pixels may also provide a response to an applied load independent of the responses of adjacent pixel.

Accordingly, the suspended pixelated seating structure includes cooperative yet independent layers, with each layer including cooperative yet independent elements, to provide maximized global support and comfort to an applied load while also adapting to and supporting localized load irregularities. Further, the load support independence provided by the suspended pixelated seating structure allows specific regions to adapt to any load irregularity without substantially affecting the load support provided by adjacent regions.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

The suspended pixelated seating structure generally refers to an assembly of multiple (e.g., three) cooperative layers for implementation in or as a load bearing structure, such as in a chair, bed, bench, or other load bearing structures. The cooperative layers include multiple elements, including multiple independent elements, to maximize the support and comfort provided. The extent of the independence exhibited by the multiple elements may depend upon, or be tuned according to, individual characteristics of each element, the connection type used to interconnect the multiple elements, or other the structural or design characteristics of the suspended pixelated seating structure. The multiple elements described below may be individually designed, positioned, or otherwise configured to suit the load support needs for a particular individual or application. In addition, the dimensions discussed below with reference to the various multiple elements are examples only and may vary widely depending upon the particular desired implementation and on the factors noted below.

Figure 1:
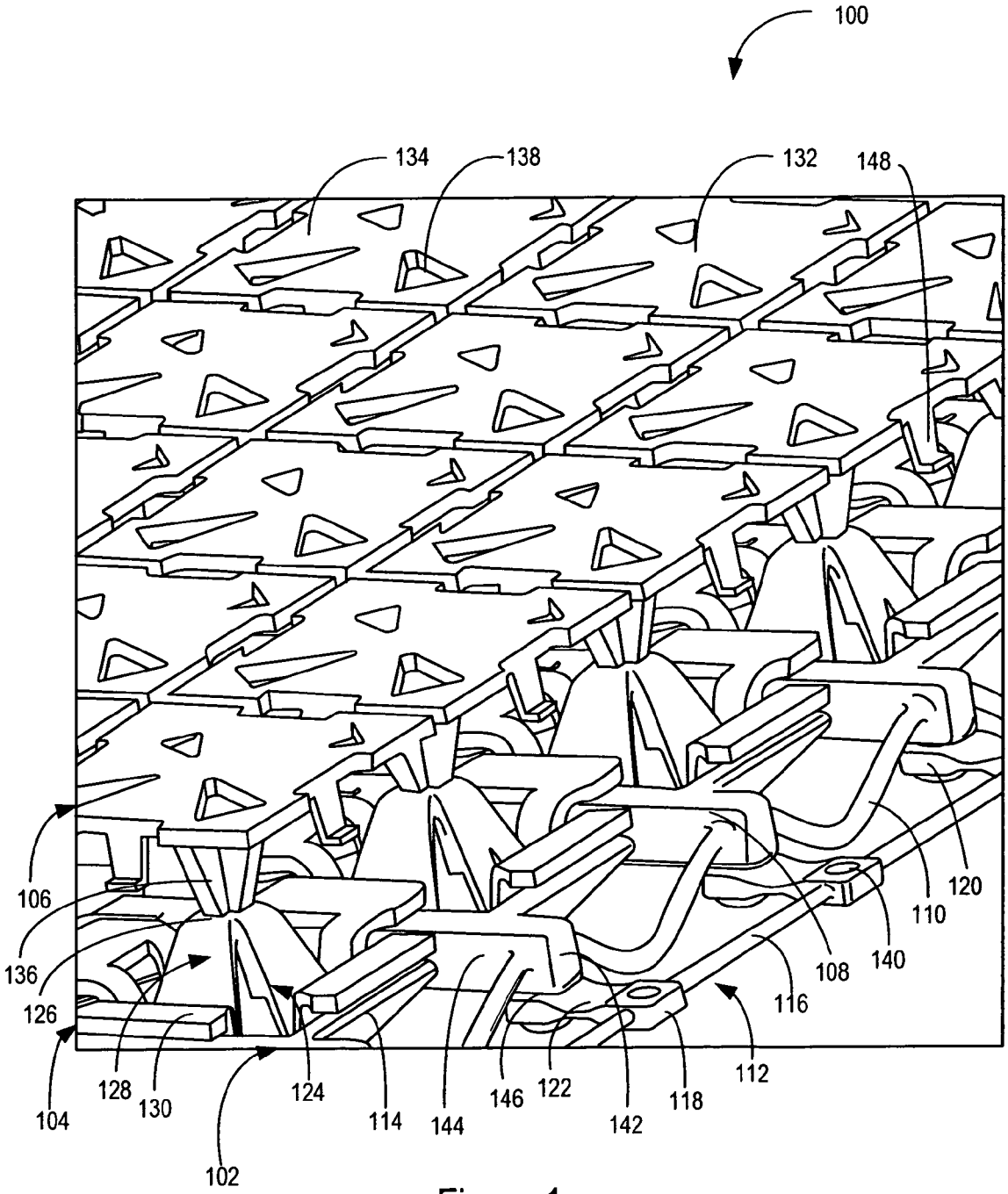
FIG. 1 shows a portion of a suspended pixelated seating structure.

FIG. 1 shows a portion of a suspended pixelated seating structure 100. The suspended pixelated seating structure 100 includes a macro compliance layer 102, a micro support layer 104, and a load support layer 106.

The macro compliance layer 102 includes multiple primary support rails 108, multiple expansion control strands 110, and a support structure frame attachment 112. Each multiple primary support rail 108 may also include multiple secondary support rails 114 extending from the primary support rail 108.

The support structure frame attachment 112 may include a frame attachment rail 116 and multiple frame connectors 118 defined along the frame attachment rail 116. The support structure frame attachment 112 also includes multiple rail attachment nodes 120 and multiple tensile expansion members 122 connected between the multiple frame connectors 118 and multiple rail attachment nodes 120.

The micro compliance layer 104 includes multiple spring elements 124 above (e.g., supported by or resting on) the multiple primary support rails 108. Each of the multiple spring elements 124 includes a top 126, a deflectable member 128, and multiple spring attachment members 130. In FIG. 1 the multiple spring elements 124 are four sided tower springs. The multiple spring elements 124 may alternatively include a variety of spring types, as is discussed below.

The load support layer 106 includes multiple pixels 132. Each of the multiple pixels 132 includes an upper surface 134 and a lower surface. The lower surface of each of the multiple pixels 132 may include a stem 136 which contacts with the top 126 of at least one of the spring elements 124. The multiple pixels 132 may also include one or more openings 138 defined within the multiple pixels 132. The openings 138 may increase the flexibility of the multiple pixels 132. The openings 138 may also be positioned and/or defined to function as ventilation elements to provide aeration to the suspended pixelated seating structure 100. The openings 138 may also be positioned and designed for aesthetic appeal. The multiple pixels 132 may be interconnected with multiple pixel connectors 148.

Figure 4:
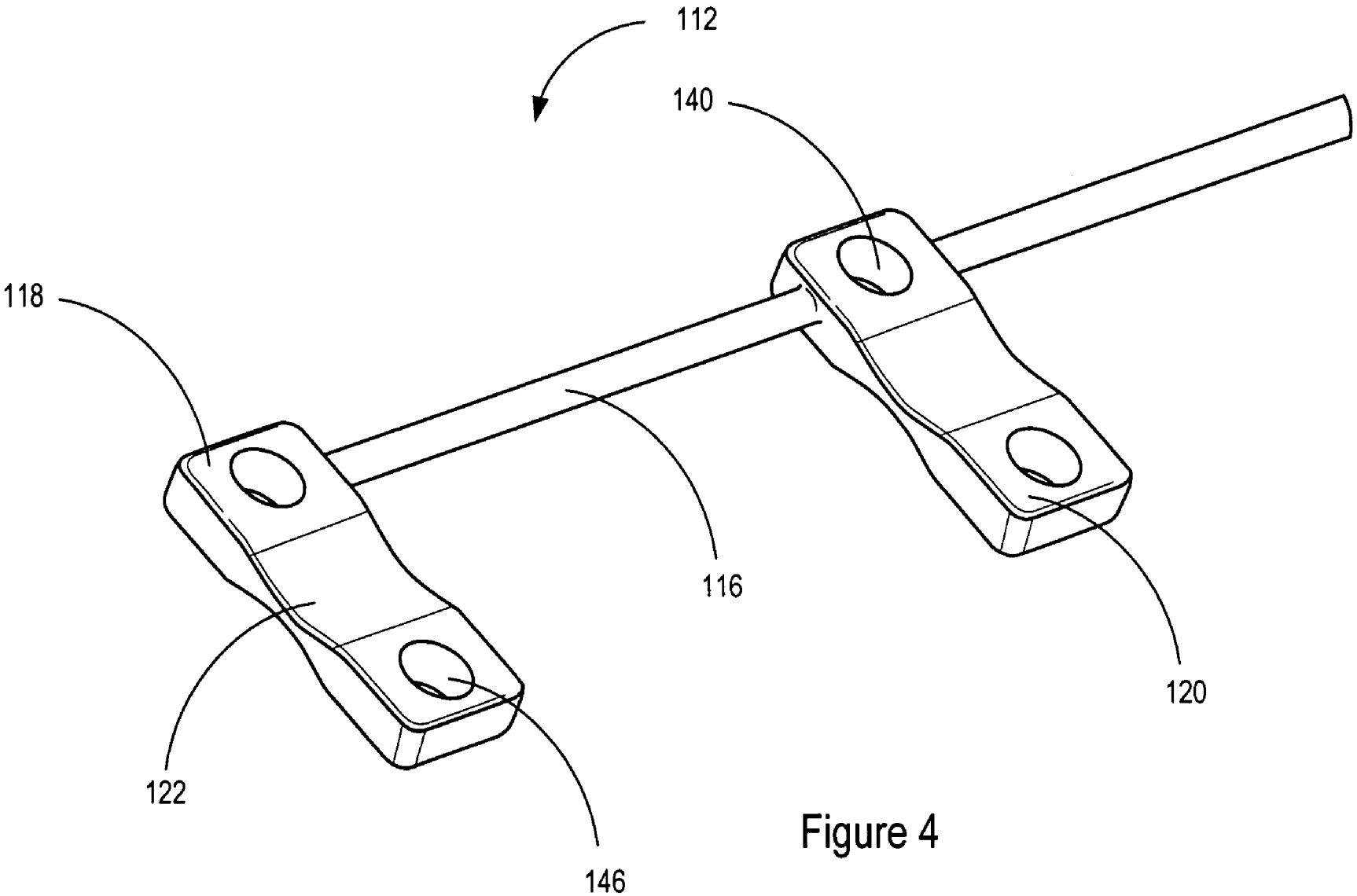
FIG. 4 shows a support structure frame attachment including multiple tensile expansion members.

The macro compliance layer 102 connects to a support structure frame via the support structure frame attachment 112. The support structure frame may be the frame of chair, bench, bed, or other load support structure. As described in this application, the macro compliance layer 102 may include the support structure frame attachment 112. In other examples, the support structure frame attachment 112 may be separate from the macro compliance layer 102. For example, the support structure frame may alternatively include the support structure frame attachment 112. In yet other examples, the suspended pixelated seating structure 100 may omit the support structure frame attachment 112. FIG. 4 shows a close-up view of the support structure frame attachment 112.

The frame connectors 118 may define frame attachment openings 140 for connection to the support structure frame. The frame connectors 118 may alternatively include cantilevered elements for securing the support structure frame attachment 112 to openings defined in the support structure frame. As another alternative, the support structure frame attachment 112 may omit the frame attachment rail 116. In this example, the frame connectors 118 may be independent of the adjacent frame connectors 118, except through their respective connections to the support structure frame. The support structure frame attachment 112 may connect to the support structure frame via a snap fit connection, an integral molding, or other connection methods.

The support structure frame attachment 112 also includes the multiple tensile expansion members 122. The multiple tensile expansion members 122 may connect between the frame attachment rail 116 and the rail attachment nodes 120. The multiple tensile expansion members 122 are flexible elements with high tensile strength, allowing the macro compliance layer 102 to effectively respond under light loads while remaining secure under heavier loads. The multiple tensile expansion members 122 include aligned material. The material may be the flexible material used to injection mold the support structure frame attachment, i.e., TPE's, PP's, TPU's, or other flexible materials. The material may be aligned using a variety of methods including compression and/or tension aligning methods.

The multiple tensile expansion members 122 connect to multiple ends 142 of the multiple primary support rails 108 via the rail attachment nodes 120. The multiple ends 142 of the multiple primary support rails 108 may be cantilevered ends 142. The rail attachment nodes 120 may define an opening 146 for connection to the cantilevered ends 142 of each multiple primary support rail 108. This connection may include a snap-fit connection, integrally molding the multiple tensile expansion members 122 to the ends 142 of the primary support rails 108, or other connection methods.

The support structure frame attachment 112 in FIG. 1 may be injection molded from a flexible material such as a thermal plastic elastomer (TPE), including Arnitel EM400 or 460, a polypropylene (PP), a thermoplastic polyurethane (TPU), or other soft, flexible materials. The support structure frame attachment 112 may be positioned around all or a portion of the perimeter of the macro compliance layer 102. Accordingly, the suspended pixelated seating structure 100 is suspended from the support structure frame.

The multiple primary support rails 108, multiple secondary support rails 114, and multiple expansion control strands 110 shown in FIG. 1 may be injection molded from a stiff material, such as glass fiber-reinforced polybutylene terephthalate (GF-PBT), glass fiber-reinforced polyamide (GF-PA), or other firm materials.

Figure 10:
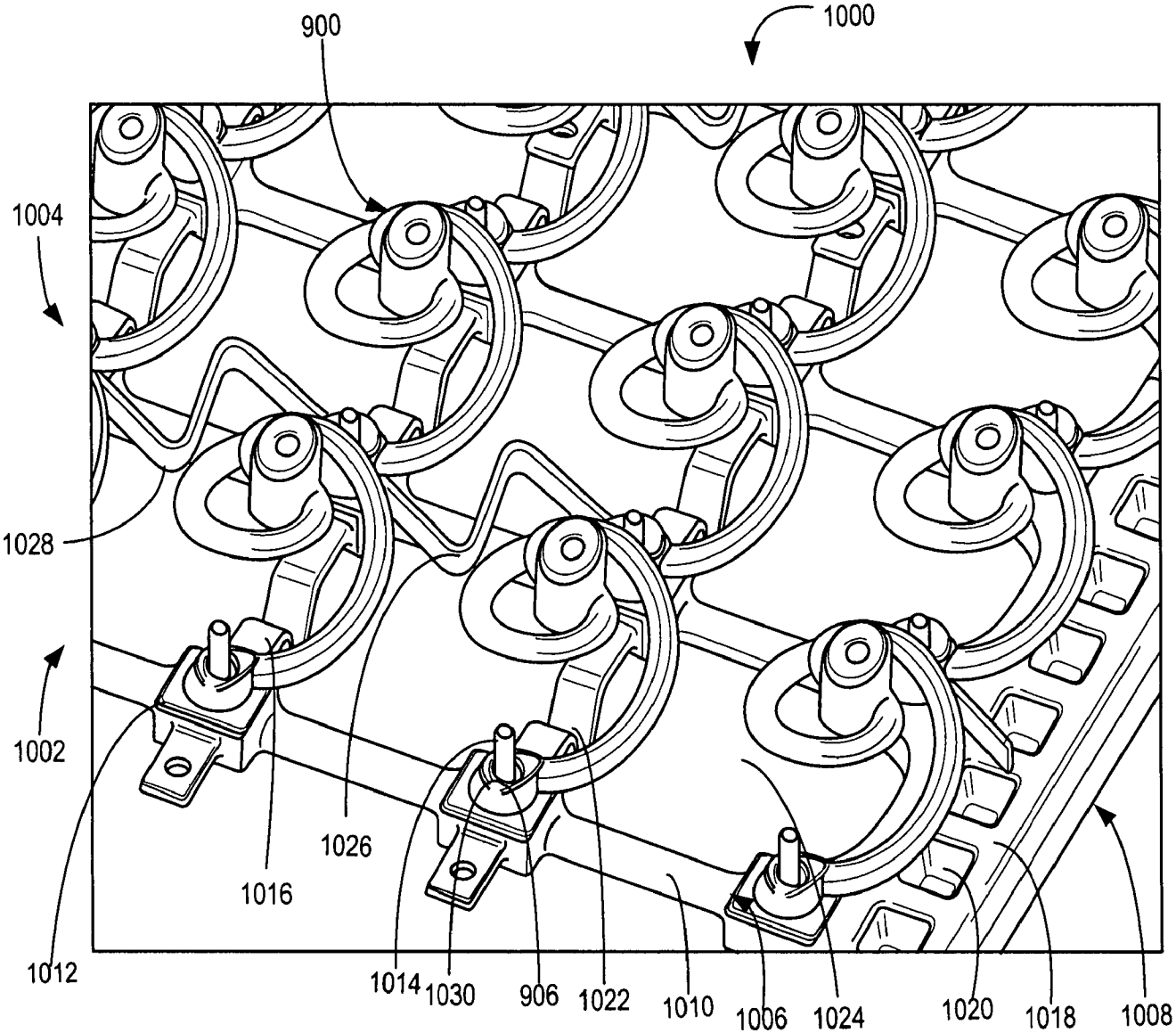
FIG. 10 shows a portion of a suspended pixelated seating structure where the multiple spring elements are multiple coil springs.
Figure 11:
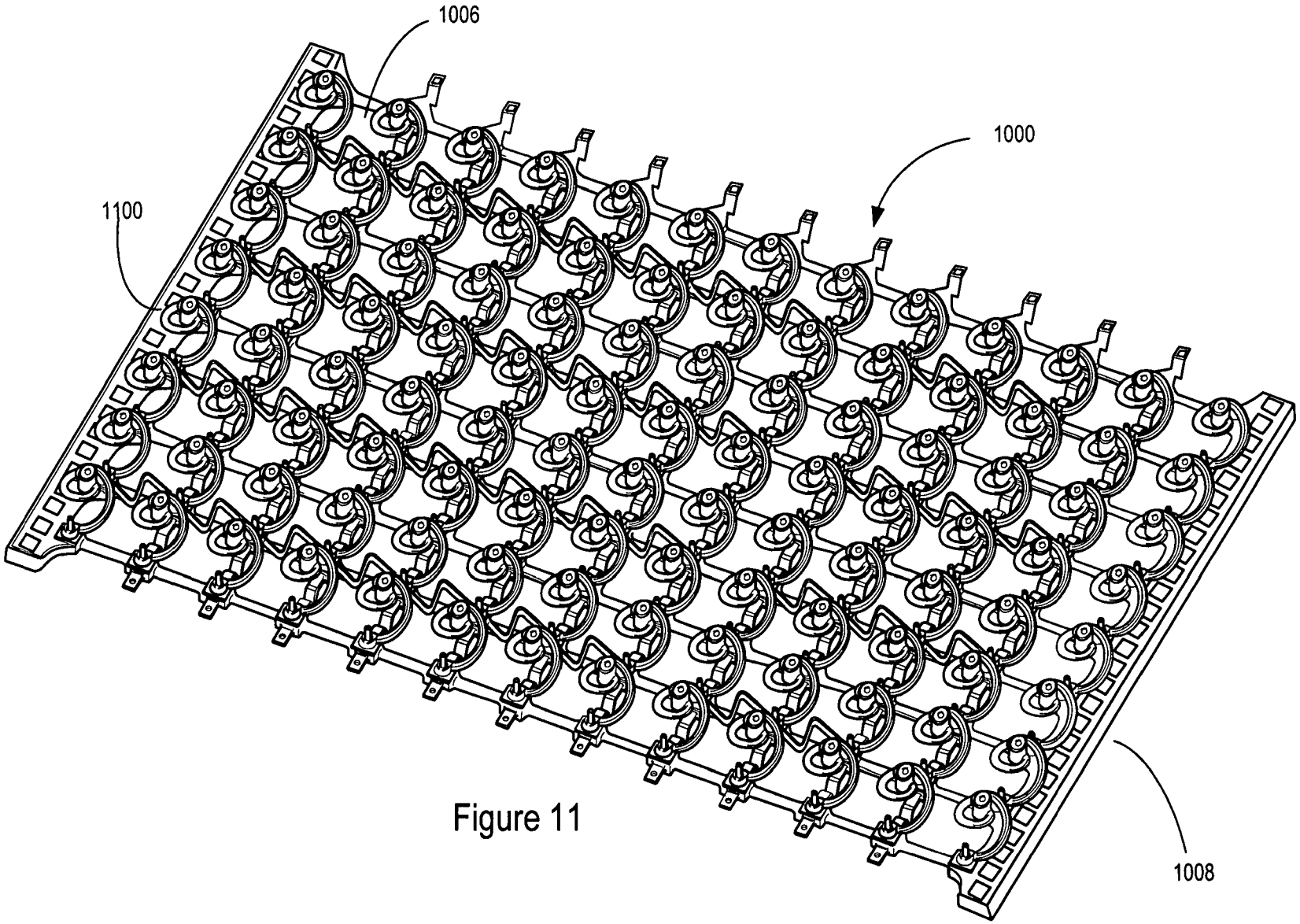
FIG. 11 shows a broader view of the suspended pixelated seating structure shown in FIG. 10.
Figure 12:
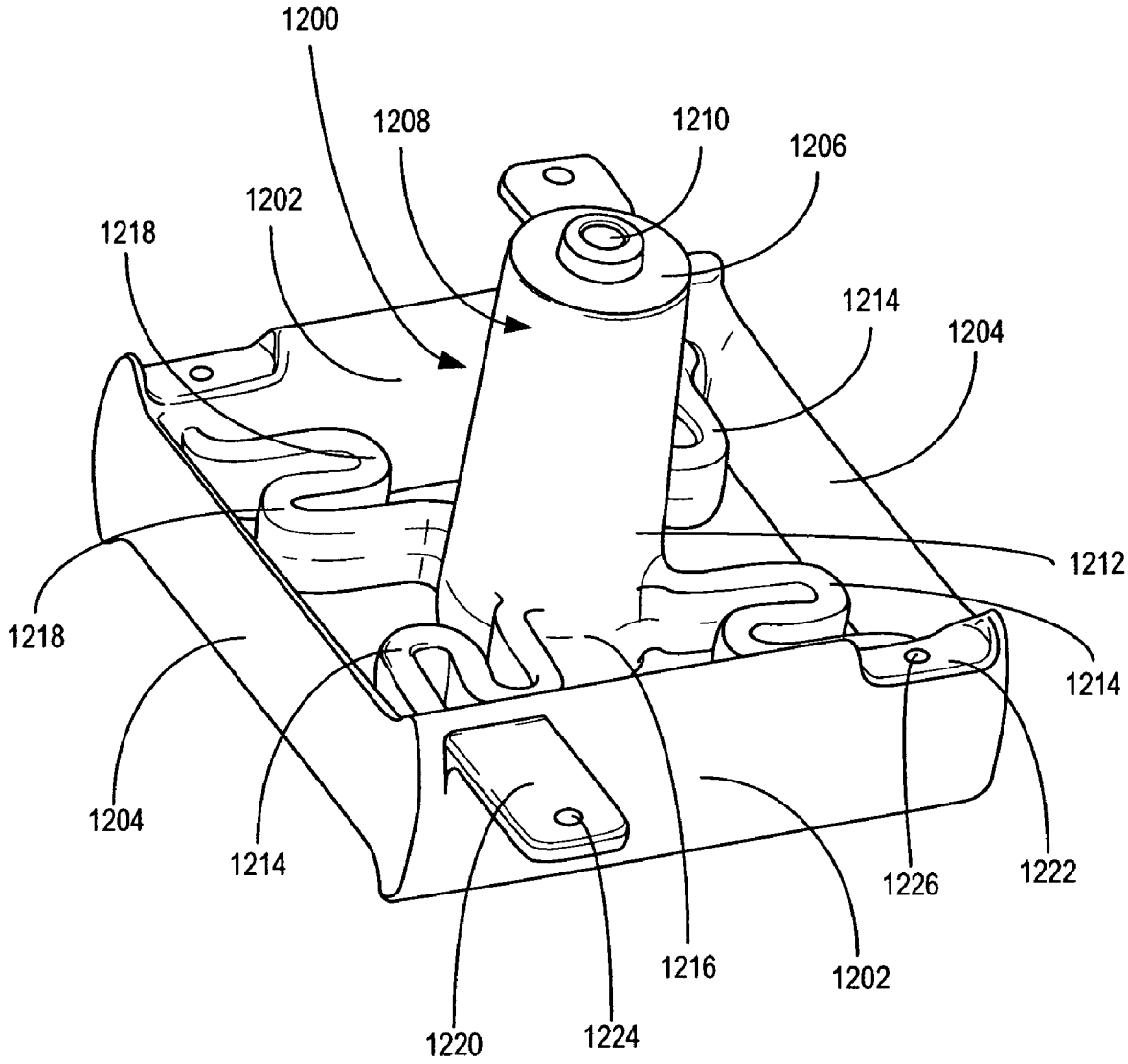
FIG. 12 shows a squiggle spring connected between adjacent primary support rails and adjacent secondary support rails.

The multiple primary support rails 108 shown in FIG. 1 include multiple shafts 144 having four sides and the multiple ends 142. The multiple primary support rails 108, however, may include alternative geometries. For example, each of the multiple primary support rails 108 may include a cylindrical shaft, as shown in FIGS. 11 and 12. Alternatively, the multiple primary support rails 108 may include a series of nodes and/or tensile expansion members defined along the primary support rails 108, as shown in FIG. 10.

As described above, the ends 142 of the multiple primary support rails 108 may be cantilevered ends 142, as shown in FIG. 4, for attachment to the support structure frame attachment 112. Alternatively, the ends 142 of the primary support rails 108 may define an opening for attachment to the multiple tensile expansion members 122. As another alternative, the ends 142 may be integrally molded to the support structure frame attachment 112. Further, the ends 142 of the multiple primary support rails 108 may instead connect to the support structure frame. As yet another alternative, the support structure frame attachment 112 may be replaced by frame springs such that the multiple primary support rails 108 are suspended from the support structure frame via the frame springs. The frame springs may be conventional springs or other spring types.

FIG. 1 shows the multiple tensile expansion members 122 extending from and attaching to the ends 142 of the multiple primary support rails 108. In other examples, including in those described below, the multiple tensile expansion members 122 may alternatively be defined along the multiple primary support rails 108 and/or along the multiple secondary support rails 114. In such examples the ends 142 of the multiple primary and/or secondary support rails 108 and 114 may connect to the support structure frame attachment 112. Where the suspended pixelated seating structure 100 defines multiple tensile expansion members 122 along the multiple primary and/or secondary support rails 108 and 114, the macro compliance layer 102, including the multiple primary and secondary support rails 108 and 114 and multiple expansion control strands 110, may be injection molded from the softer, flexible materials used to form the support structure frame attachment 112 discussed above.

Multiple tensile expansion members 122 defined along the multiple primary and/or secondary support rails 108 and 114 may be aligned using a variety of methods including compression and/or tension aligning methods. For example, in examples where the multiple tensile expansion members 122 are defined along the multiple primary and secondary support rails 108 and 114, the aligned portions defined along the multiple primary support rails 108 may be compression aligned while the aligned portion defined along the multiple secondary support rails 114 may be tension aligned, or visa versa.

The alternative suspended pixelated seating structures discussed below define the multiple tensile expansion members 122 along the multiple primary support rails 108. In the examples discussed below, the multiple tensile expansion members 122 may be defined along substantially the entire length of the multiple primary support rails 108 or as discrete aligned segments along the length of the multiple primary support rails 108. In each alternative example below, the multiple tensile expansion members 122 may alternatively be included in the support structure frame attachment 112 in the manner shown in FIG. 1.

As the macro compliance layer 102 deflects downward when a load is applied to the suspended pixelated seating structure 100, the multiple primary support rails 108 may spread apart from each other to facilitate adaptation to the load. The multiple expansion control strands 110 provide for controlled separation of the multiple primary support rails 108 to prevent the macro compliance layer 102 from excess separation, such as when a heavier load is applied. The multiple expansion control strands 110 may be non-linear, as shown in FIG. 1. In this manner, the multiple expansion control strands 110 can provide slack for the separation of the multiple primary support rails 108.

The amount of slack provided by the multiple expansion control strands 110 may be tuned in a variety of ways. For example, the number and/or degree of bends in the multiple expansion control strands 110 may affect the amount of slack provided. In addition, varying the type of material used to form the multiple expansion control strands 110 may affect the amount of slack. The multiple expansion control strands 110 may alternatively be linear, as shown, for example, in FIG. 15.

FIG. 1 shows the multiple expansion control strands 110 connected between the ends 142 of each adjacent primary support rail 108. Alternatively, the multiple expansion control strands 110 may connect between less than all adjacent primary support rails 108. For example, the multiple expansion control strands 110 may connect between every other set of adjacent primary support rails 108. The multiple expansion control strands 110 may also connect between adjacent primary support rails 108 at multiple positions along the length of the multiple primary support rails 108, as shown, for example, in FIG. 10.

The multiple secondary support rails 114 may provide further support to the suspended pixelated seating structure 100. In particular, the multiple primary and secondary support rails 108 and 114 support the multiple spring elements 124 of the micro compliance layer 104. The multiple spring elements 124 may be secured on adjacent primary support rails 108 and on adjacent secondary support rails 114 via the spring attachment members 130. The spring attachment members 130 may be integrally molded to the primary and secondary support rails 108 and 114, may attach via a snap-fit connection, or may be secured using other methods.

The macro compliance layer 102 may or not be pre-loaded. For example, prior to connecting the macro compliance layer 102 may initially be formed, such as through the injection molding process, with a shorter length than is needed secure the macro compliance layer 102 to the support structure frame. Before securing the macro compliance layer 102 to the support structure frame, the macro compliance layer 102 may be stretched or compressed to several times its original length. As the macro compliance layer 102 settles down after being stretched, the macro compliance layer 102 may be secured to the support structure frame when the macro compliance layer 102 settles to a length that matches the width of the support structure frame.

As another alternative, the macro compliance layer 102 may settle down and then be repeatedly re-stretched until the settled down length of the macro compliance layer 102 matches the width of the support structure frame. The macro compliance layer may be pre-loaded in multiple directions, such as along its length and/or width. In addition, different pre-loads may be applied to different regions of the macro compliance layer 102. Applying different pre-loads according to region may be done in a variety of ways, such as by varying the amount of stretching or compressing at different regions and/or varying the thickness of different regions.

FIG. 1 shows an example of the micro compliance layer 104 in which the multiple spring elements 124 are four sided tower springs. The four sided tower spring is described below and shown in FIGS. 5 and 6. The multiple spring elements 124 shown in FIG. 1 have an approximate length and width of 40 mm×40 mm and an approximate height of 16 mm. However, each of the multiple spring elements 124 may include alternative dimensions according to a variety of factors including the spring element's 124 relative location in the suspended pixelated seating structure 100, the needs of a specific application, or according to a number of other considerations. For example, the height may be varied to provide a three-dimensional contour to the suspended pixelated seating structure 100, providing a dish-like appearance to the suspended pixelated seating structure 100. In this example, the height of the multiple springs elements 124 positioned in the center portion of the micro compliance layer 104 may be less than the height of the multiple spring elements 124 positioned at the outer portions of the micro compliance layer 104, with a gradual or other type of increase in height in the multiple spring elements 124 between the center and outer portions of the micro compliance layer 104.

Figure 7:
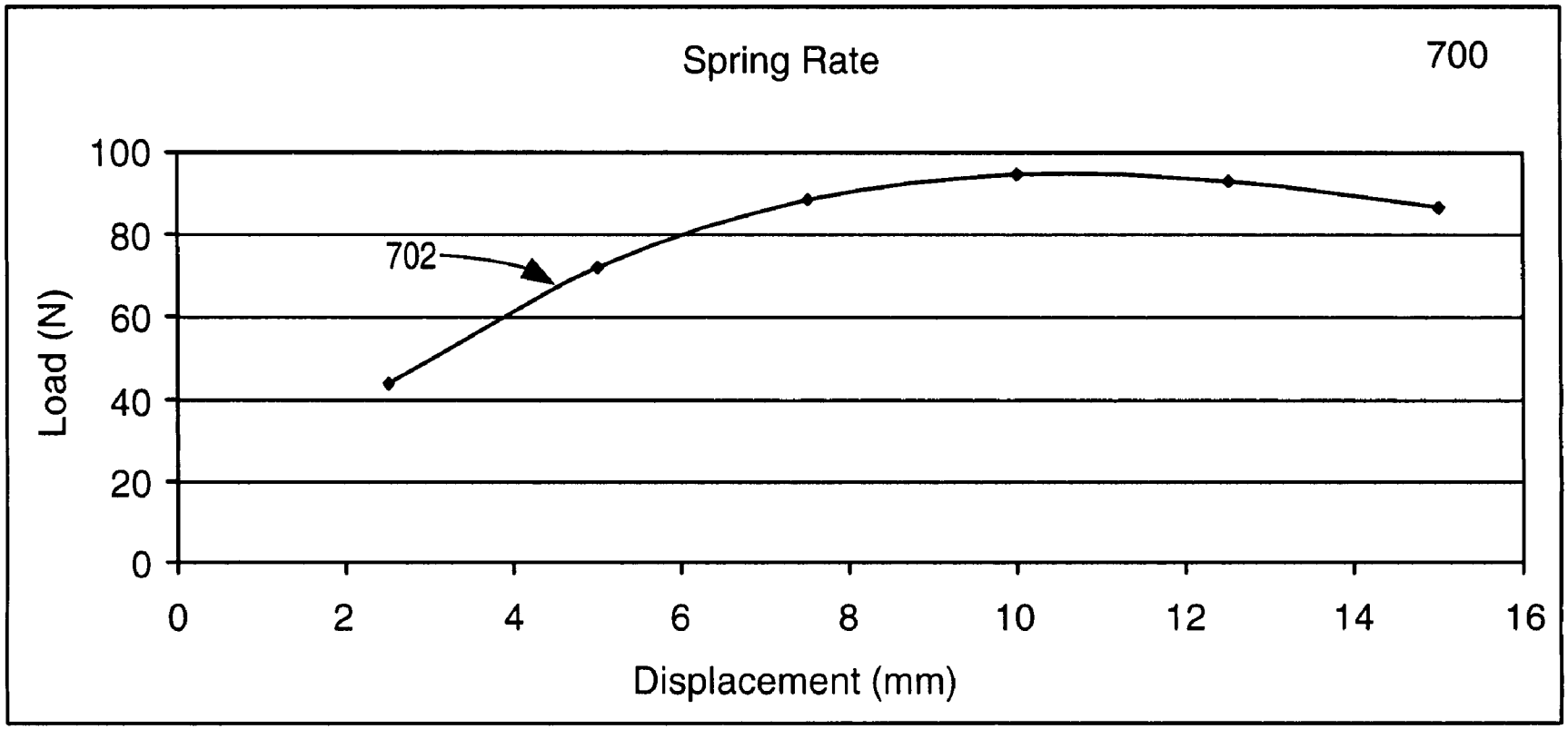
FIG. 7 shows a plot of the approximate spring rate of the four sided tower spring.

Alternatively, the micro compliance layer 104 may include a variety of other spring types. Examples of other spring types, as well as how they may be implemented in a suspended pixelated seating structure, are described below and shown in FIGS. 9-18. The spring types used in the micro compliance layer 104 may include alternative orientations. For example, the spring types may be oriented upside-down, relative their orientation described in this application. In this example, the portion of the spring described in this application as the top would be oriented towards and connect to the macro compliance layer. Further, in this example the deflectable members may connect to the load support layer. The deflectable members may connect to the load support layer via multiple spring attachment members However, the examples discussed in this application do not constitute an exhaustive list of the spring types, or possible orientations of spring types, that may be used to form the micro compliance layer 104. The spring elements 124 may exhibit a range of spring rates, including linear, non-linear decreasing, non-linear increasing, or constant rate spring rates. FIG. 7 shows a plot of the approximate non-linear decreasing spring rate for the four side tower spring 124.

The micro support layer 104 connects on the macro compliance layer 102. In particular, the spring attachment members 130 connect on the multiple primary support rails 108 and in some examples, on the multiple secondary support rails 114. This connection may be an integral molding, a snap fit connection, or other connection method. The multiple spring elements 124 may be injection molded from a TPE, such as Arnitel EM460, EM550, or EL630, a TPU, a PP, or from other flexible materials. The multiple spring elements 124 may be injection molded individually or as a sheet of multiple spring elements 124.

As the micro compliance layer 104 includes multiple substantially independent deflectable elements, i.e., the multiple spring elements 124, adjacent portions of the micro compliance layer 104 may exhibit substantially independent responses to a load. In this manner, the suspended pixelated seating structure 100 not only deflects and conforms under the "macro" characteristics of the applied load, but also provides individual, adaptable deflection to "micro" characteristics of the applied load.

The micro compliance layer 104 may also be tuned to exhibit varying regional responses in any particular zone, area, or portion of the support structure to provide specific support for specific parts of an applied load. The regional response zones may differ in stiffness or any other load support characteristic, for example. Certain portions of the suspended pixelated seating structure 100 may be tuned with different deflection characteristics. One or more individual pixels which form a regional response zone, for example, may be specifically designed to a selected stiffness for any particular portion of the body. These different regions of the suspended pixelated seating structure 100 may be tuned in a variety of ways. As described in more detail below with reference to the load support layer 106, variation in the spacing between the lower surface of each pixel 132 and the macro compliance layer 102 (referring to the spacing measured when no load is present) may vary the amount of deflection exhibited under a load. The regional deflection characteristics of the suspended pixelated seating structure 100 may be tuned using other methods as well, including using different materials, spring types, thicknesses, geometries, or other spring characteristics for the multiple spring elements 124 depending on their relative locations in the suspended pixelated seating structure 100.

The load support layer 106 connects to the micro compliance layer 104. The lower surface of each pixel 132 is secured to the top 126 of a corresponding spring element 124. This connection may be an integral molding, a snap fit connection, or other connection method. The lower surface may connect to the top 126 of the spring element 124, or may include a stem 136 or other extension for resting upon or connecting to the spring elements 124. The top 126 of each spring element 124 may define an opening for receiving the stem 136 of the corresponding pixel. Alternatively, the top 126 of each multiple spring element 124, or of any other type of spring element described below, may include a stem or post for connecting to an opening defined in the corresponding pixel.

Whether the lower surface of each pixel 132 includes a stem 136 may depend on the type of spring element 124 used, a predetermined spring deflection level, and/or other characteristics or specifications. When a load presses down on the load support layer 106, the multiple pixels 132 press down on the tops 126 of the multiple spring elements 124. In response, the multiple spring elements 124 deflect downward to accommodate the load. As the multiple spring elements 124 deflect downward, the lower surfaces of the multiple pixels 132 move toward the macro compliance layer 102. One or more multiple spring elements 124 may deflect far enough such that the lower surfaces of the corresponding pixels 132 abut on top of the macro compliance layer 102. In this instance, the spring element 124 corresponding to the pixel 132 whose lower surface abuts with the macro compliance layer 102 may not deflect further, relative to itself.

The amount of deflection exhibited by the spring element 124 before the lower surface of the corresponding pixel 132 abuts on top of the macro compliance layer 102 is the spring deflection level. Relative to ground, however, the multiple spring elements 124 may deflect further in that the micro compliance layer 104 may deflect downward under a load as the macro compliance 102 layer deflects under a load. As such, the multiple spring elements 124 may individually deflect under a load according to the spring deflection level, and may also, as part of the micro compliance layer 104, deflect further as the micro compliance layer 104 bends downward under a load.

The spring element 124 may stop deflecting under a load when the lower surface of the pixel 132 abuts on top of some portion of the micro compliance layer 104 such as on top of the multiple spring attachment members 130. This may be the case where the spring attachment members 130 are positioned above the macro compliance layer 102, such as in the suspended pixelated seating structure 100 shown in FIG. 1.

The spring deflection level may be determined before manufacture and designed into the suspended pixelated seating structure 100. For example, the suspended pixelated seating structure may be tuned to exhibit an approximately 25 mm of spring deflection level. In other words, the suspended pixelated seating structure 100 may be designed to allow the multiple spring elements 124 to deflect up to approximately 25 mm. Thus where the micro compliance layer 104 includes spring elements 124 of 16 mm height (i.e., the distance between the top of the macro compliance layer 102 and the top 126 of the spring element 124), the lower surfaces of the multiple pixels 132 may include a 9 mm stem. As another example, where the micro compliance layer 104 includes spring elements 124 of 25 mm height, the lower surfaces of the multiple pixels 132 may omit stems; but may rather connect to the tops 126 of the multiple spring elements 124. As explained above, the height of each spring element 124 may vary according to a number of factors, including its relative position within the suspended pixelated seating structure 100.

The multiple pixels 132 may be interconnected with multiple pixel connectors 148. The L-shaped element shown in FIG. 1 is a cross sectional portion of a pixel connector 148. Accordingly, FIG. 1 shows the multiple pixels 132 interconnected at their sides via the multiple pixel connectors 148. The load support layer 106 may include a variety of pixel connectors 148, such as planar or non-planar connectors, recessed connectors, bridged connectors, or other elements for interconnecting the multiple pixels 132, as described below. The multiple pixel connectors 148 may be positioned at a variety of locations with reference to the multiple pixels 132. For example, the multiple pixels connectors 148 may be positioned at the corners, sides, or other positions in relation to the multiple pixels 132. The multiple pixel connectors 148 provide an increased degree of independence as between adjacent pixels 132, as well as enhanced flexibility to the load support layer 106. For example, the multiple pixel connectors 148 may allow for flexible downward deflection, as well as for individual pixels 132 to move or rotate laterally with a significant amount of independence.

The multiple pixels 132 may define openings 138 within the pixels 132 for added deflection of the suspended pixelated seating structure 100. The openings 138 allow for added flexibility and adaptation by the multiple pixels 132 when placed under a load. The openings 138 may also be defined within the multiple pixels 132 to enhance the aesthetic characteristics of the suspended pixelated seating structure 100.

The load support layer 106 may be injection molded from a flexible material such as a TPE, PP, TPU, or other flexible materials. In particular, the load support layer 106 may be formed from independently manufactured pixels 132, or may be injection molded as a sheet of multiple pixels 132. The load support layer 106 may also connect to a support structure via support structure connection elements, as is described below and shown, for example, in FIG. 23.

When under a load, the load may contact with and press down on the load support layer 106. Alternatively, the suspended pixelated seating structure 100 may also include a seat covering layer secured above the load support layer 106. The seat covering layer may include a cushion, fabric, leather, or other seat covering materials. The seat covering layer may provide enhanced comfort and/or aesthetics to the suspended pixelated seating structure 100.

Figure 2:
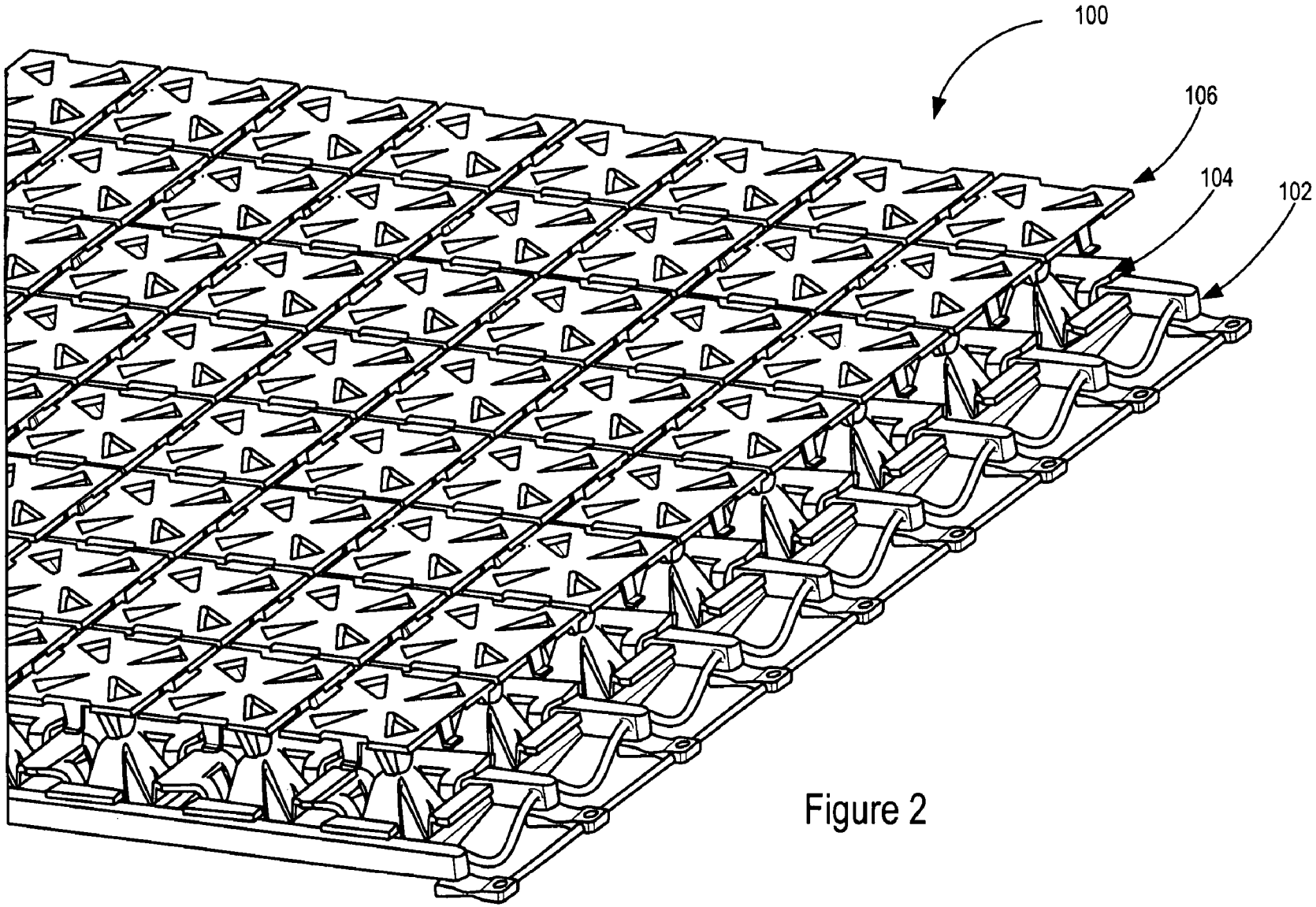
FIG. 2 shows a broader view of the suspended pixelated seating structure shown in FIG. 1.

FIG. 2 shows a broader view of the suspended pixelated seating structure 100 shown in FIG. 1. While FIG. 2 shows a rectangular suspended pixelated seating structure 100, the suspended pixelated seating structure 100 may include alternative shapes, including a circular shape. The support structure frame attachment 112 may be positioned around all or a portion of the perimeter of the suspended pixelated seating structure 100.

Figure 3:
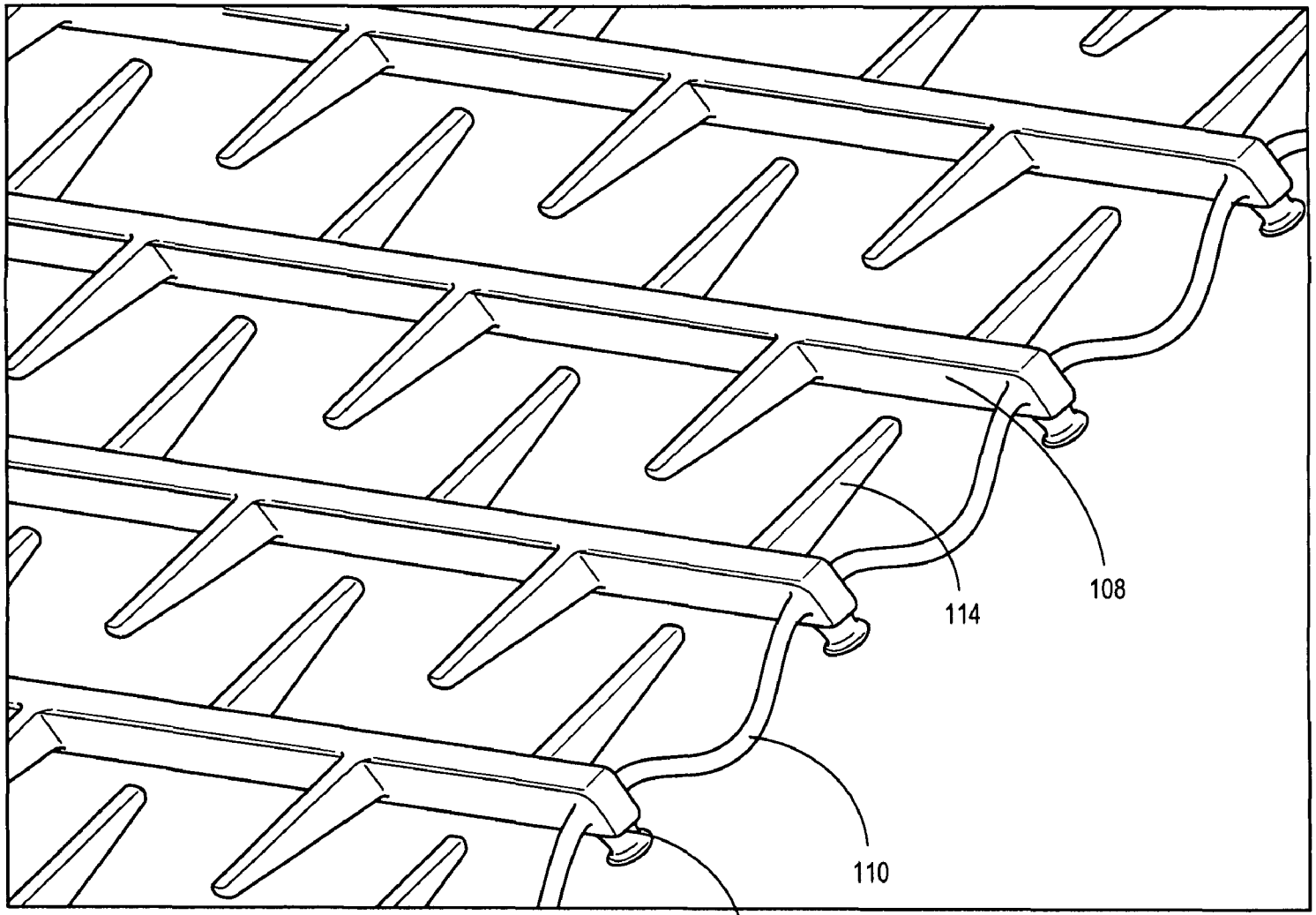
FIG. 3 shows the portion of the macro compliance layer shown in FIG. 1.

FIG. 3 shows a portion of the macro compliance layer 102. As noted above in connection with FIG. 1, the macro compliance layer 102 includes the multiple primary support rails 108, multiple secondary support rails 114, and multiple expansion control strands 110. The multiple primary support rails 108 include multiple cantilevered ends 142 for attachment to the support structure frame attachment.

The multiple primary support rails 108 are aligned substantially in parallel, but may adhere to other alignments depending on the desired implementation. The multiple primary support rails 108 may be of equal length, or of varying lengths. For example, the length of the multiple primary support rails 108 may vary where the suspended pixelated seating structure 100 is designed for attachment to a circular support structure.

The multiple secondary support rails 114 extend between adjacent primary support rails 108, but contact with one primary support rail 108. Alternatively, the multiple secondary support rails 114 may vary in length, including extending the entire distance between and contacting adjacent primary support rails 108. As another alternative, the suspended pixelated seating structure 100 may omit secondary support rails 114. The secondary support rails 114 may be linear or non-linear. Non-linear secondary support rails may function as expansion control strands to provide for controlled separation of the multiple primary support rails 108 when a load is imposed.

FIG. 4 shows the support structure frame attachment 112. As described above, the support structure frame attachment 112 includes the frame attachment rail 116, the multiple frame connectors 118, and the multiple rail attachment nodes 120. The support structure frame attachment 112 also includes the multiple tensile expansion members 122 connected between the multiple rail attachment nodes 120 and the frame connectors 118. FIG. 4 shows circular openings 140 and 146 defined within the multiple frame connectors 118 and multiple rail attachment nodes 120 respectively. These openings 140 and 146 may alternatively include other geometrically shaped openings.

As described above, the macro compliance 102 layer may include the support structure frame attachment 112 for connection to the support structure frame; but may alternatively omit the support structure frame attachment 112 in connecting to the support structure frame. Further, the support structure frame attachment 112 may omit the multiple tensile expansion members 122, which may alternatively be defined, for example, along the multiple primary support rails 108.

Figure 5:
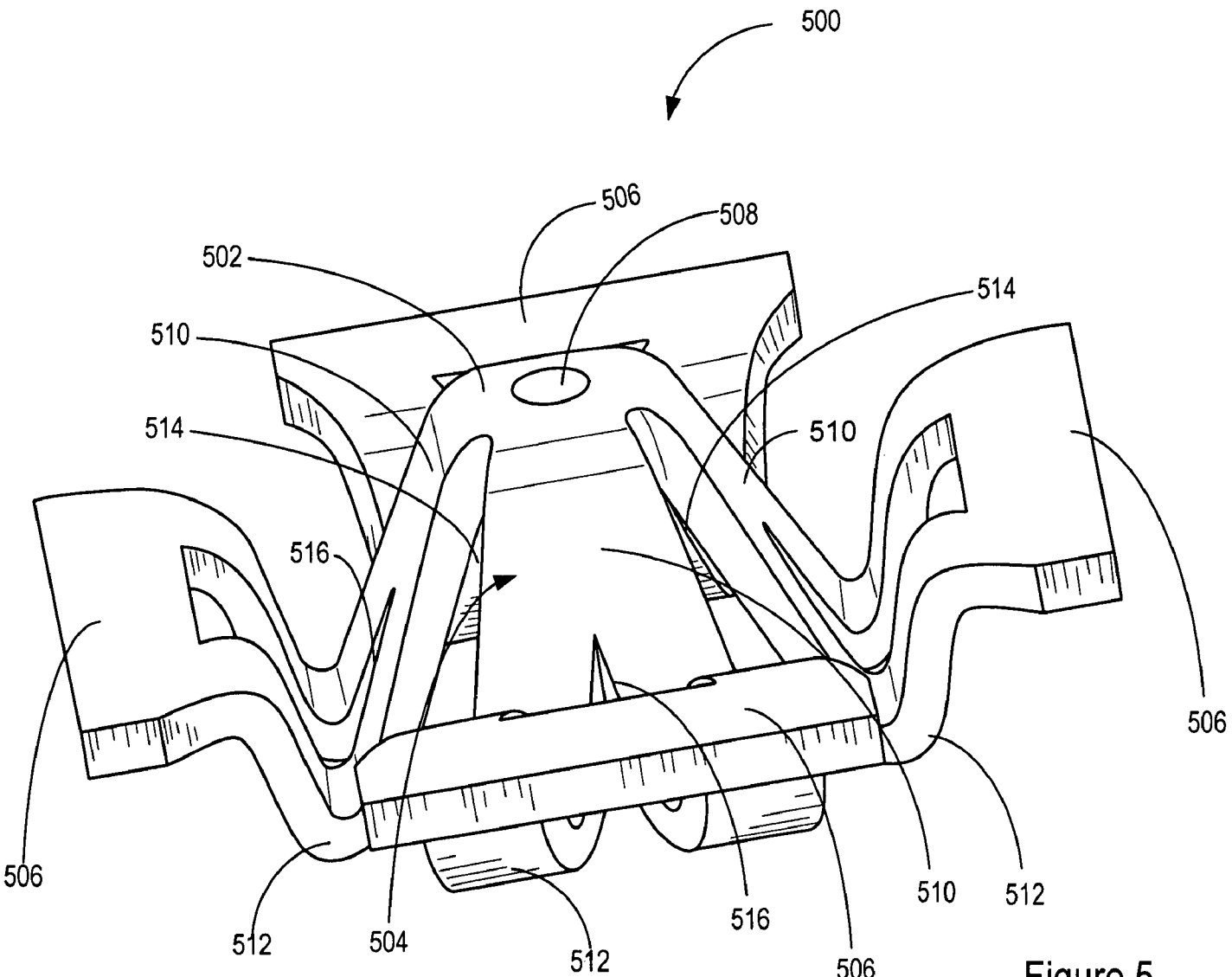
FIG. 5 shows a four sided tower spring.

FIG. 5 shows a four sided tower spring 500. The four sided tower spring 500 includes a top 502, a deflectable member 504, and multiple spring attachment members 506. The top 502 connects to or supports the lower surface of a pixel of the load support layer. The top 502 may define an opening 508 to facilitate the connection or interaction with a portion of a pixel.

The deflectable member 504 shown in FIG. 5 includes four angled sides 510. The angled sides 510 connect to the top 502 of the spring member 124 and angle downward from the top 502 toward bottoms 512 of the angled sides 510. The deflectable member 504 may define gaps 514 between the adjacent angled sides 510. In FIG. 5, each gap 514 begins at the top 502 of the spring member 124 and widens along the length of the angled sides 510. The deflectable member 504 may also define deflection slits 516 along the angled sides 510. The deflection slits 516 may begin at some point between the top 502 of the spring member 124 and the bottoms 512 of the angled sides 510, where the width of each deflection slit 516 gradually widens downward toward the bottom 512 of the angled sides 510. The gaps 514 defined between adjacent angled sides 510, as well as the deflection slits 516 defined along the angled sides 510, help facilitate deflection of the spring 500 under a load.

The four sided tower spring 500 may be tuned with varying deflection characteristics depending on where they are positioned within the micro compliance layer. Varying one or more of the design characteristics of the spring 500 may tune the spring element's deflection characteristics, such as spring rate.

The following are examples of design variations that may be used to tune the four sided tower spring 500 to exhibit certain deflection characteristics. The slope, length, thickness, material and/or width of the angled sides 510 may vary. The angled sides 510 may not define a deflection slit 516, or alternatively, may define the deflection slit 516 beginning closer or farther from the top 502 of the spring 500. Similarly, the deflectable member 504 may not define gaps 514 between adjacent angled sides 510, or alternatively, may define the gaps 514 beginning farther from the top 502 of the four sided tower spring 500. Other variations in design characteristics of the spring element 124 may also affect the spring's 500 responsiveness to a load.

At the bottoms 512 of the angled sides 510 the deflectable member 504 bends upwards and connects to the spring attachment members 506 for connection to the macro compliance layer. The spring attachment members 506 include a planar surface 512 in FIG. 5, but may alternatively include a non-planar, contoured, or other surface geometry. As described above, this connection may be an injection molding, a snap fit connection, or other connection method.

Figure 6:
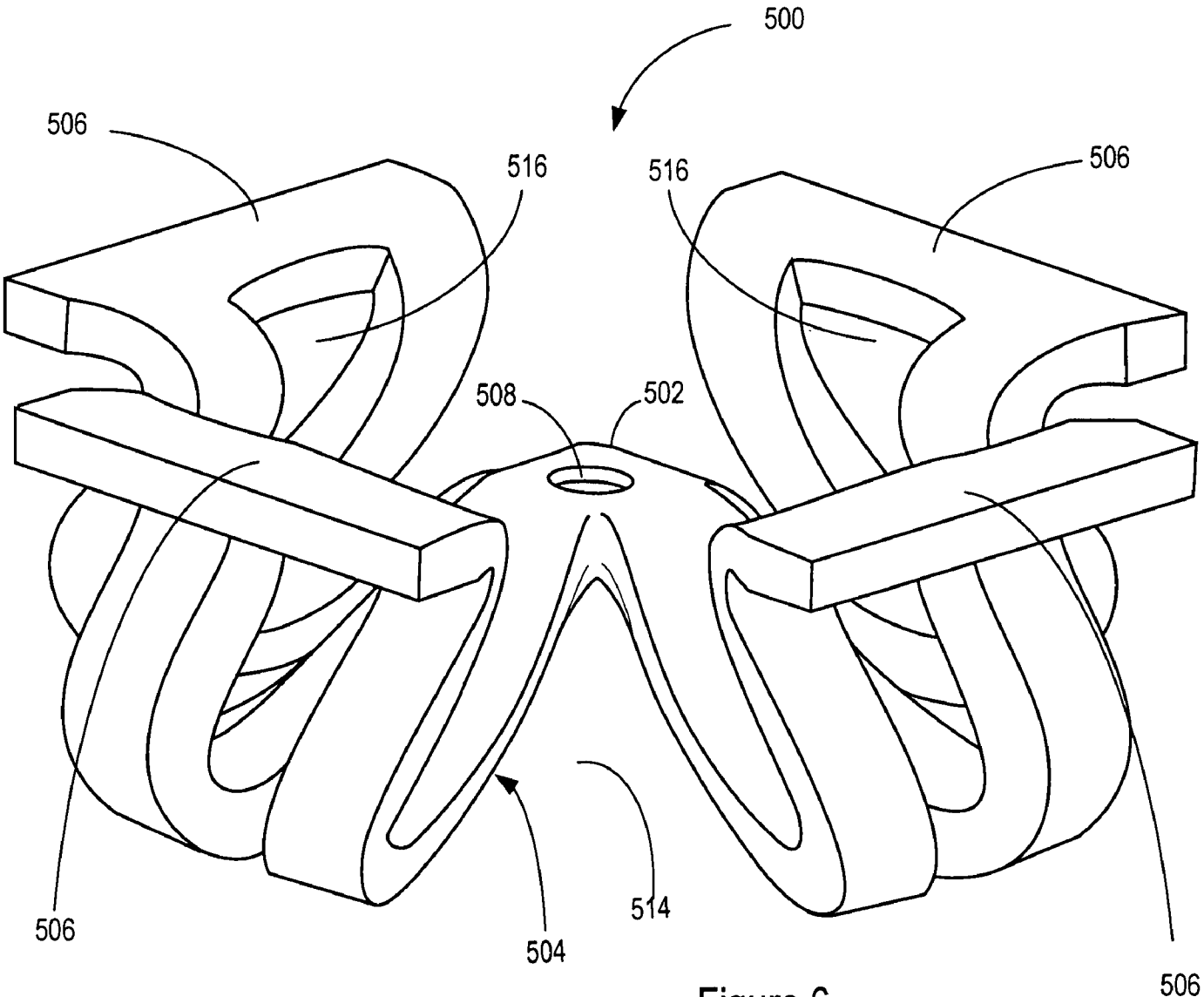
FIG. 6 shows the four sided tower spring shown in FIG. 5 deflecting under a load.

FIG. 6 shows the four sided tower spring 500 deflecting under a load. When a load is applied to the load support layer, the lower surface of each pixel presses downward onto the top 502 of the corresponding four sided tower spring 500. The deflectable member 504 bends to accommodate the load as the top 502 of the spring 500 is pressed downward. As described above, the gaps 514 and deflection slits 516 facilitate deflection under a load. For example, as the four sided tower spring 500 deflects under a load, the gaps 514 widen in response. Different initial gap 514 dimensions may be selected, among other deflection characteristics, to determine how far the four sided tower spring 500 deflects, as well as how much resistance to deflection the spring's 500 own structure may provide.

FIG. 7 shows a plot 700 of the approximate spring rate of the four sided tower spring 500. The plot 700 shows a non-linear decreasing spring rate 702 determined from a finite element analysis. According to the plot 700, the force required to deflect the four sided tower spring 500 initially increases substantially linearly with respect to displacement, but substantially levels off when a designed amount of displacement has been achieved.

Figure 8:
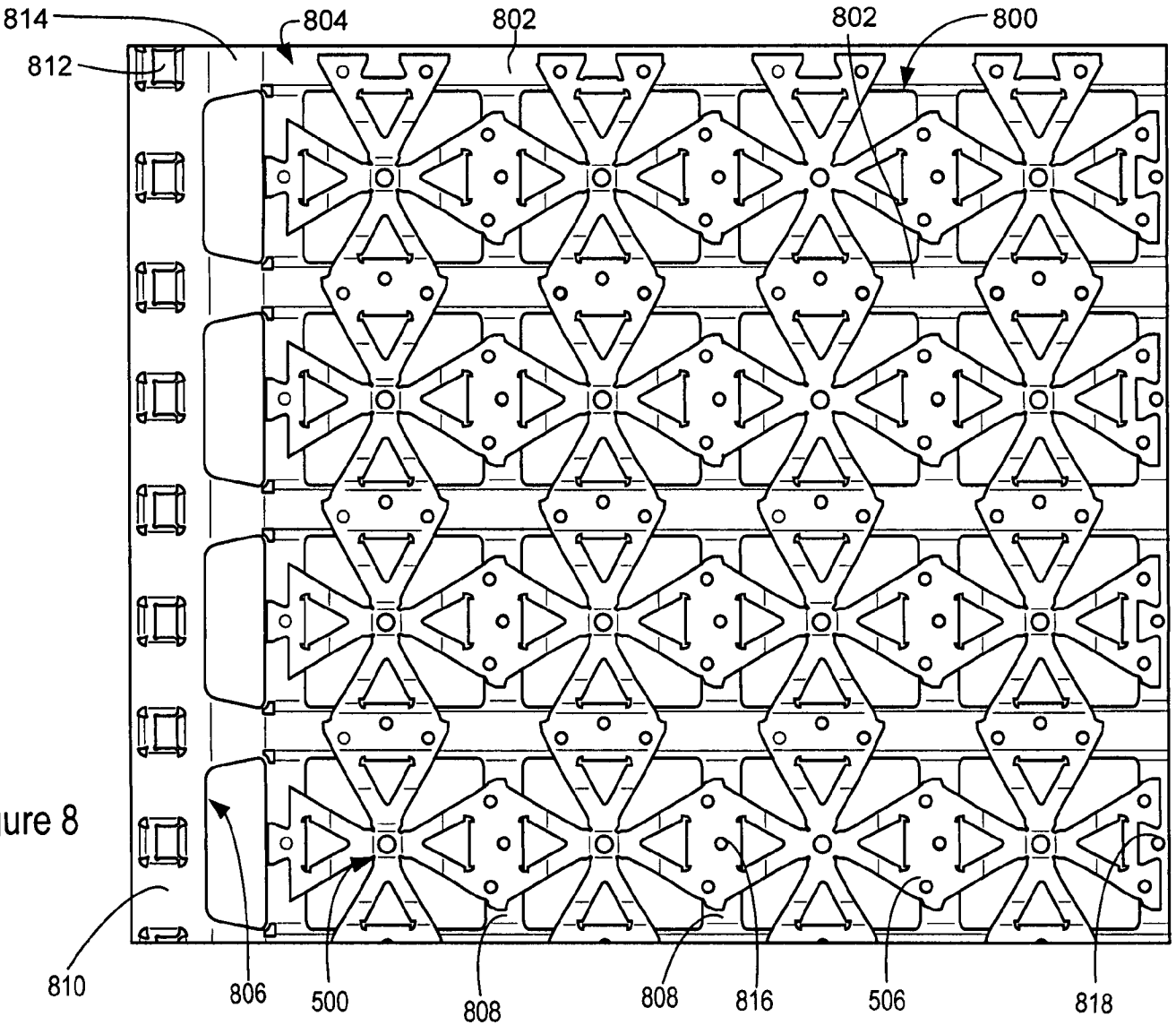
FIG. 8 shows a top view of the macro and micro compliance layers of a suspended pixelated seating structure including multiple tensile expansion members defined along the multiple primary support rails.

FIG. 8 shows a top view of the macro and micro compliance layers of a suspended pixelated seating structure 800. FIG. 8 shows multiple tensile expansion members 802 defined along multiple primary support rails 804. The multiple tensile expansion members 802 may be defined along the entire length, or a substantial portion, of the multiple primary support rails 804, as shown in FIG. 8. Alternatively, the multiple tensile expansion members 802 may be defined along discrete segments of the multiple primary support rails 804, such as in FIG. 15. The macro compliance layer includes the multiple primary support rails 804, a support structure frame attachment 806, and multiple secondary support rails 808 extending between and contacting adjacent multiple primary support rails 804.

The support structure frame attachment 806 includes a frame attachment rail 810 and frame connectors 812 defined along the frame attachment rail 810. The frame connectors 812 shown in FIG. 8 are openings 812 defined along the frame attachment rail 810, but may alternatively be cantilevered elements or other elements for connecting the suspended pixelated seating structure 800 to the support structure frame. The support structure frame attachment 806 also includes multiple support rail connectors 814 for connecting the support structure frame attachment 806 to the multiple primary support rails 804. This connection may be an integral molding, snap fit connection, or other connection method.

As discussed above, where the macro compliance layer includes multiple tensile expansion members 802 defined along the multiple primary support rails 804, the macro compliance layer may be injection molded from the more flexible materials, such as TPE's, TPU's, PP's, or other materials described as being used to form the support structure frame attachment shown in FIG. 1.

The multiple tensile expansion members 802 may be defined along the entire length of the multiple primary support rails 804, or along segmented portions of the multiple primary support rails 804. Alternatively, the multiple tensile expansion members 802 may be defined along the multiple secondary support rails 808 instead of, or in addition to, being defined along the multiple primary support rails 804.

The multiple spring elements shown in FIG. 8 are the four sided tower springs 500 described above. The spring attachment members 506 may include multiple spring connectors 816. In FIG. 8, the multiple spring connectors 816 are openings defined within the spring attachment members 506. The openings 816 may correspond to multiple support rail connectors 818 defined along the multiple primary and/or secondary support rails 804, 808. The multiple spring connectors 816 and multiple support rails connectors 818 may be openings, protrusions, or other elements for connecting the four sided tower springs 500 to the multiple primary and/or secondary support rails 804, 808. The multiple spring connectors 816 and multiple support rails connectors 818 may facilitate this connection through an integral molding, snap fit connection, or other connection method.

Figure 9:
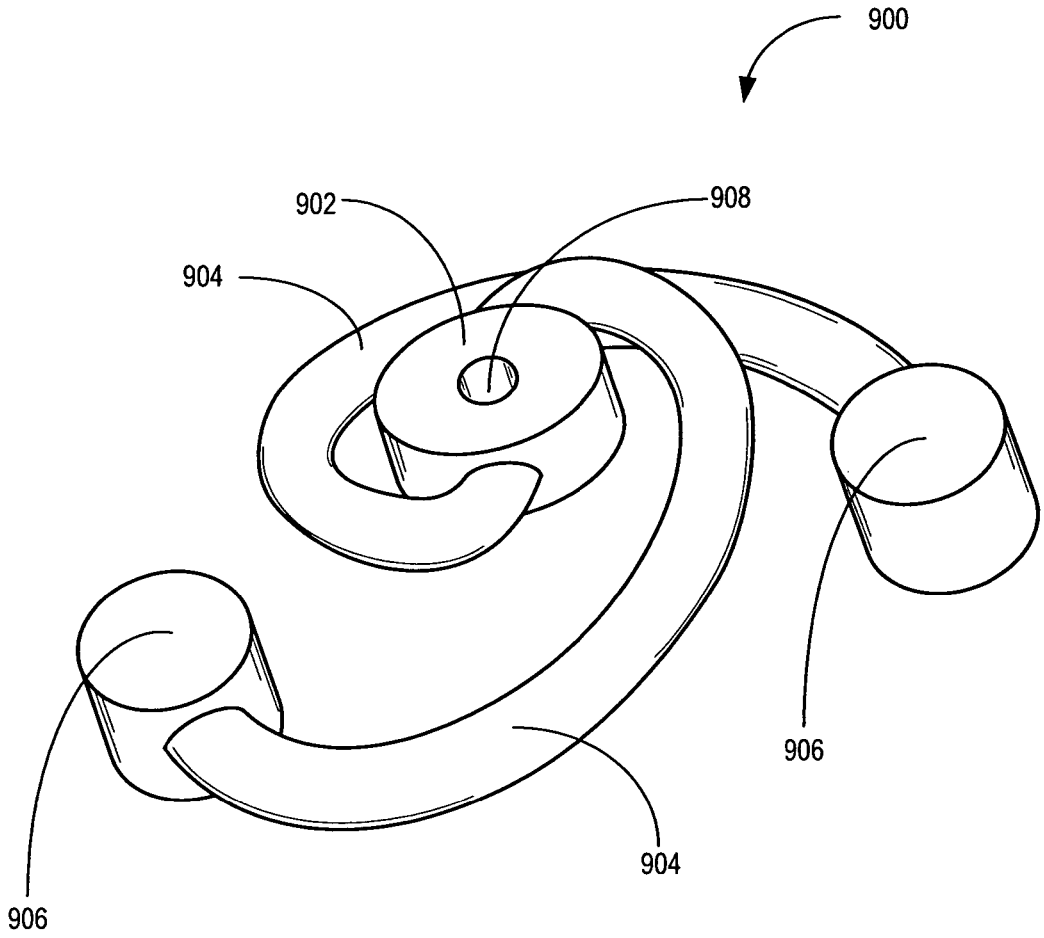
FIG. 9 shows a coil spring.

FIG. 9 shows a coil spring 900. The micro compliance layer may include one or more coil springs 900 as the multiple spring elements. The coil spring 900 includes a top 902, deflectable member 904, and spring attachment members 906. The top may define an opening 908 for connection to a load support layer. The deflectable member 904 includes spiraled arms 904 which spiral from the top 902 of the spring element down to the spring attachment members 906. Other sizes, shapes, and geometries of deflectable member may be additionally or alternatively implemented. FIG. 9 shows elliptically shaped coil springs. The coil springs 900 may alternatively include other geometries, such as a circular geometry.

Under a load, the top 902 of the coil spring 900 is pressed down and the coil spring 900 deflects or compresses in response. The coil spring 900 may exhibit an approximately linear or non-linear spring rate. As described above with reference to the four sided tower spring 500, the deflection characteristics of the coil spring 900 may be tuned for various applications. For example, variation in pitch, thickness, length, degree of curvature, material, or other spiraled arm design characteristics may be selected to tune the deflection characteristics of the coil spring 900 for any desired stiffness or responsiveness. FIG. 9 shows the coil spring 900 having different major and minor diameters, with the diameter of the coil spring gradually decreasing from the bottom (major diameter) towards the top (minor diameter). The coil spring 900 may alternatively include a substantially uniform diameter throughout the height of the coil spring 900 or may include other alternative variations in diameter.

FIG. 10 shows a portion of a suspended pixelated seating structure 1000 in which the multiple spring elements are coil springs 900. The pixelated seating structure includes a macro compliance layer 1002, a micro compliance layer 1004, and a load support layer. The macro compliance layer 1002 includes multiple primary support rails 1006 and a support structure frame attachment 1008. The macro compliance layer 1002 also includes multiple tensile expansion members 1010 and multiple nodes 1012 defined along multiple primary support rails 1006. The nodes 1012 include posts 1014 for connection to the micro compliance layer 1004. The macro compliance layer 1002 further includes multiple expansion control strands 1016 extending between adjacent primary support rails 1006. The support structure frame attachment 1008 includes a frame attachment rail 1018 and multiple frame connectors 1020. The multiple frame connectors 1020 in FIG. 10 include multiple openings 1020 defined along the frame attachment rail 1018 for connection to a support structure frame.

Each of the multiple expansion control strands 1016 include a U-shaped bend 1022 to allow slack for the controlled separation of adjacent primary support rails 1006 when under a load. The multiple expansion control strands 1016 may alternatively be linear. In other examples, the macro compliance layer 1002 may omit the multiple expansion control strands 1016. The bend 1022 may be varied to provide different amounts of slack, such as by changing the number of bends 1022, the degree of curve in the bends 1022, the length of the bends 1022, the material from which the bends 1022 are made, or other design characteristics.

FIG. 10 shows the multiple coil springs 900 positioned above the multiple expansion control strands 1016. Alternatively or additionally, one or more coil springs 900 may be positioned above the space 1024 defined between adjacent primary support rails 1006 and adjacent expansion control strands 1016.

The micro compliance layer 1004 includes the multiple coil springs 900 and multiple deflection control runners 1026. The multiple deflection control runners 1026 connect to and extend between spring attachment members 906 of adjacent coil springs 900. The multiple deflection control runners 1026 may run substantially parallel to the multiple primary support rails 1006. The multiple deflection control runners 1026 include multiple bends 1028 for controlled deflection of the suspended pixelated seating structure 1000. The multiple deflection runners 1026 may alternatively be linear, or may be omitted from the micro compliance layer 1004. The multiple deflection control runners 1026 may also be varied, such as by changing the number of multiple bends 1028, the degree of curve in the multiple bends 1028, the length of the bends 1028, the material from which the bends 1028 are made, or other design characteristics.

FIG. 10 shows multiple deflection control runners 1026 positioned over every other primary support rail 1006. The deflection control runners 1026 may be positioned over all primary support rails 1006, or over some smaller number of primary support rails 1006. Additionally, the deflection control runners 1026 may run continuously along the length of the corresponding primary support rail 1006, or may run along the length of the corresponding primary support rail 1006 in discrete segments.

As the suspended pixelated seating structure 1000 deflects down under a load, the multiple tensile expansion members 1010 allow expansion along the length of the multiple primary support rails 1006. The multiple deflection control runners 1026 straighten as the multiple primary support rails 1006 deflect downward and become taut when the multiple primary support rails 1006 have deflected by a certain amount. The amount of deflection exhibited by the multiple primary support rails 1006 before the multiple deflection control runners 1026 tauten may be tuned by adjusting various characteristics of the deflection control runners 1026, including thickness, number of bends, degree of curve in the bends 1028, or other characteristics.

Each coil spring 900 defines an opening 1030 in each of the multiple spring attachment members 906 for receiving the multiple posts 1014 protruding up from the multiple nodes 1012. The spring attachment members 906 may connect to the multiple posts 1014 with a snap fit connection, may be integrally molded, or may connect through a variety of other connection methods. Alternatively, the coil springs 900 may include multiple posts protruding down from the spring attachment members 906 for connection to multiple openings defined in the multiple nodes 1012.

FIG. 11 shows a broader view of the suspended pixelated seating structure 1000 shown in FIG. 10. FIG. 10 shows a second support structure frame attachment 1100 connected to the multiple primary support rails 1006. A load support layer connects on the micro compliance layer 1004.

FIG. 12 shows a squiggle spring 1200 connected between adjacent primary support rails 1202 and adjacent secondary support rails 1204. The squiggle spring 1200 may be used as a spring element in any of the seating structures. The squiggle spring 1200 includes a top 1206 and a deflectable member 1208. The squiggle spring 1200 includes an opening 1210 defined within the top 1206 for connection to a load support layer. The deflectable member 1208 includes a shaft 1212 extending downward from the top 1206 and curved strands 1214 connected to and extending from the shaft 1212. The shaft 1212 includes a base 1216. The curved strands 1214 may connect to and extend between the base 1216 of the shaft 1212 and, extending from the base 1216 and connecting to the primary support rails 1202 and/or secondary support rails 1204. In FIG. 12, the curved strands 1214 are integrally molded between the base 1216 and the support rails 1202 and 1204. The curved strands 1214 shown in FIG. 12 include an approximate 7 mm×3 mm thickness.

The curved strands 1214 include a multiple bends 1218. As the top 1206 of the squiggle spring 1200 is pressed down under a load, the curved strands 1214 initially provide minimal resistance as the spring 1200 deflects downward. The spring 1200 continues to deflect downward until the curved strands 1214 become taut. When the curved strands 1214 tauten, the force necessary to continue deflecting the spring 1200 substantially increases. As such, the squiggle spring 1200 may provide a non-linear increasing spring rate. The spring rate may be tuned for various application, such as by varying the number of bends 1218 in the curved strands 1214, the degree of curve in the bends 1218, the number of curved strands 1214 connected between the shaft 1212 and the multiple primary and/or secondary support rails 1202, 1204, the thickness of the curved strands 1214, or by varying other design characteristics.

The height of the shaft 1212 may vary as well. For example, where the spring deflection level described above is defined as 25 mm, the shaft 1212 may extend up to 25 mm above the macro compliance layer. In this example, the top 1206 of the squiggle spring 1200 may connect to the lower surface of a corresponding pixel, rather than connecting to a stem extending from the lower surface of the pixel. Where the suspended pixelated seating structure includes a load support layer including multiple stems, the height of the shaft 1212 may be designed such that when connected, the combined height of the shaft 1212 and corresponding stem equals the spring deflection level.

FIG. 12 shows the shaft 1212 as a cylindrical shaft 1212. The geometry of the shaft 1212, however, may vary. For example, the shaft 1212 may extend from the top 1206 with no slope, or with some amount of slope, giving the shaft 1212 a conical shape. The shaft 1212 may include other geometries or configurations as well.

FIG. 12 shows multiple expansion control strands 1220 extending from the multiple primary support rails 1202 and multiple recessed segments 1222 defined along the multiple primary support rails 1202. Each multiple expansion control strand 1220 may define an opening 1224 for connection to the corresponding recessed segment 1222 of an adjacent primary support rail 1202. Each recessed segment 1222 may also define an opening 1226 to facilitate this connection. The multiple expansion control strands 1220 may be non-linear.

Figure 13:
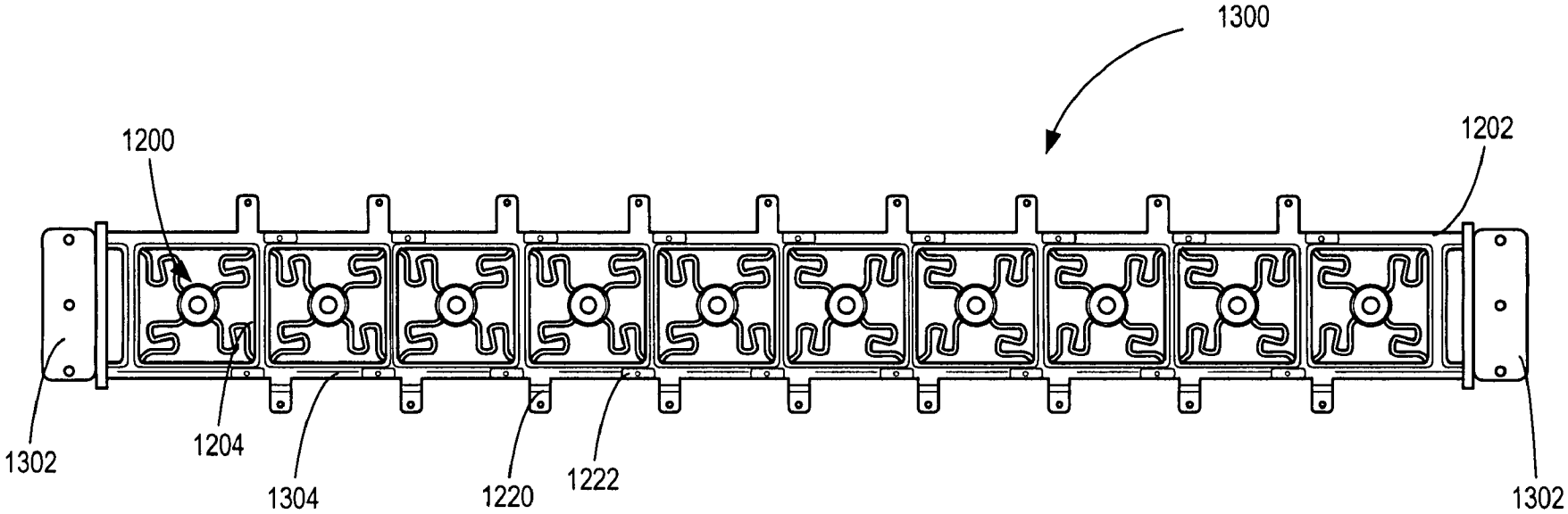
FIG. 13 shows the top view of a portion of a suspended pixelated seating structure where the multiple spring elements are squiggle springs.
Figure 14:
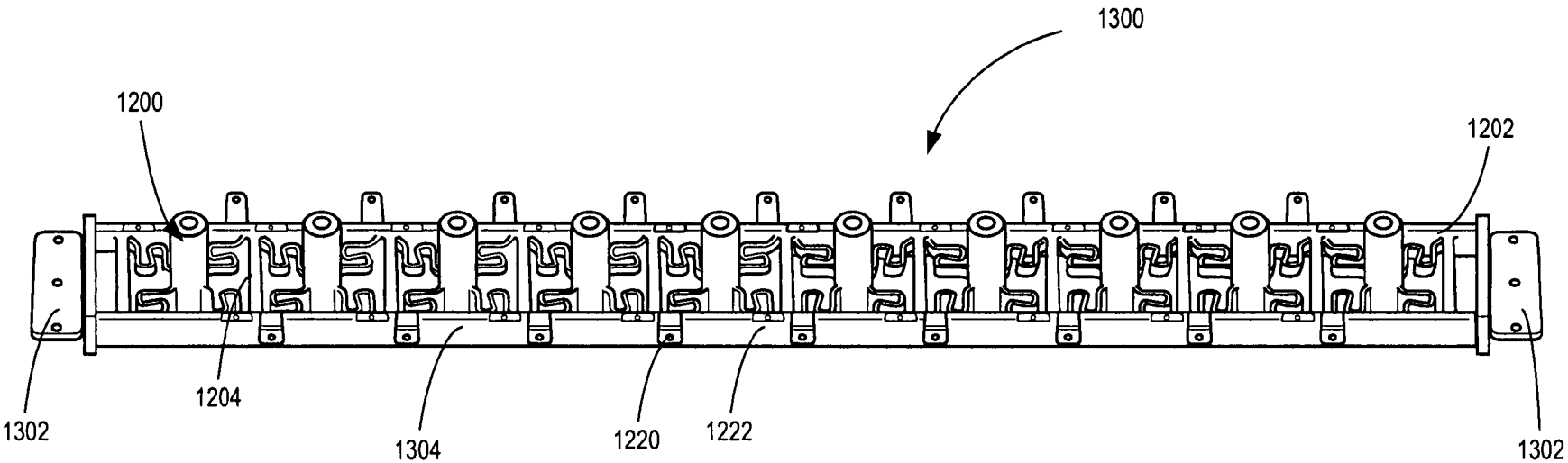
FIG. 14 shows an angled top view of the portion of the suspended pixelated seating structure shown in FIG. 13.

FIG. 13 shows the top view of a portion of a suspended pixelated seating structure 1300 where the multiple spring elements are squiggle springs 1200. FIG. 14 shows an offset top view of the portion of the suspended pixelated seating structure 1300 shown in FIG. 13. The suspended pixelated seating structure using squiggle springs 1200 includes multiple primary support rails 1202, multiple secondary support rails 1204, and support structure frame attachments 1302 connected at opposite ends of the primary support rails 1202. The suspended pixelated seating structure 1300 also includes multiple tensile expansion members 1304 defined along the multiple primary support rails 1202. The squiggle springs 1200 shown in these Figures are integrally molded between adjacent primary and secondary support rails 1202, 1204.

Figure 15:
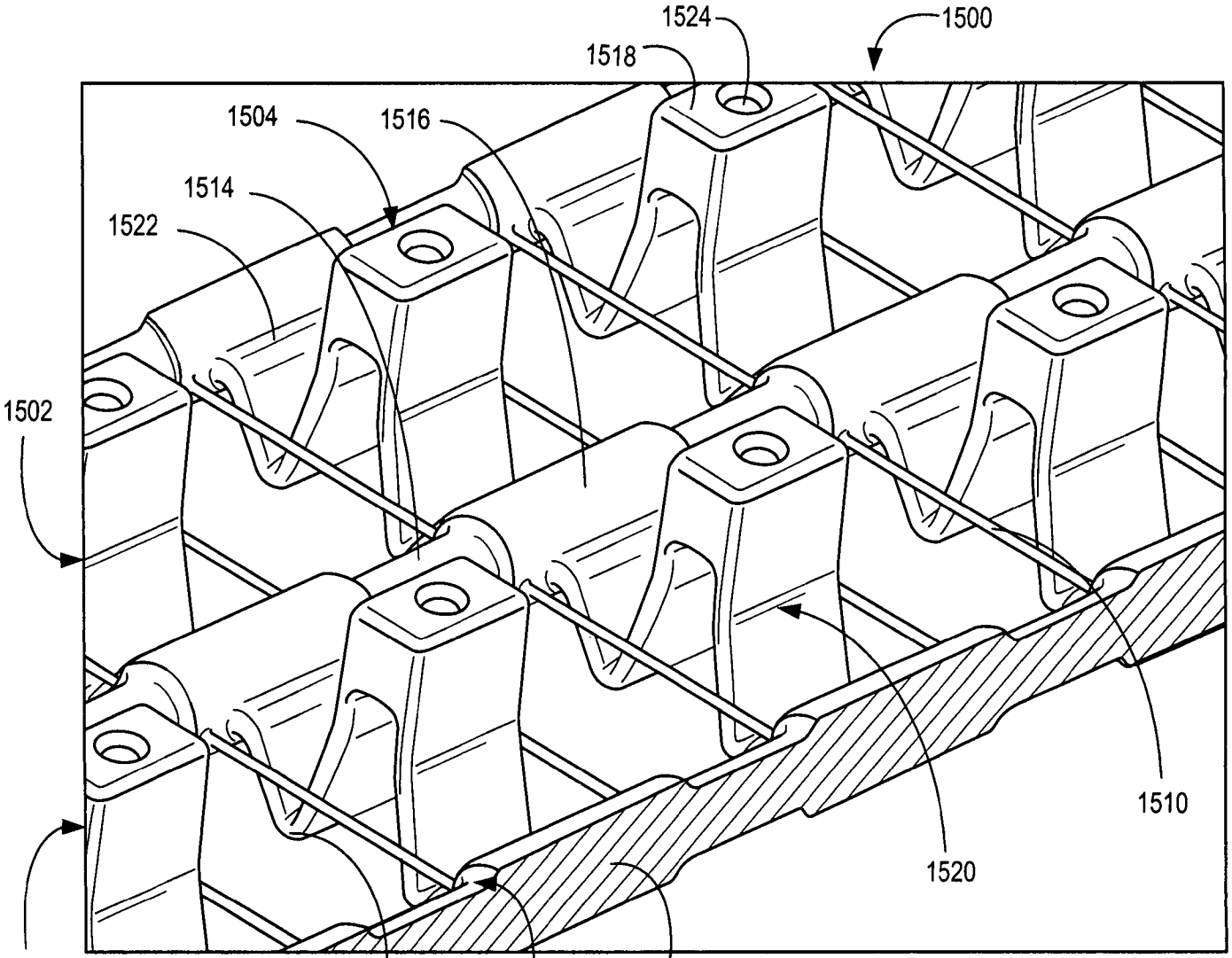
FIG. 15 shows a portion of a suspended pixelated seating structure where the micro compliance layer includes two sided tower springs.

FIG. 15 shows a portion of a suspended pixelated seating structure 1500 where the micro compliance layer 1502 includes two sided tower springs 1504. The two sided tower springs 1504 is another alternative for the spring element. The suspended pixelated seating structure also includes a macro compliance layer 1506 integrally connected to the micro compliance layer 1502.

The macro compliance layer 1506 includes multiple primary support rails 1508 and multiple expansion control strands 1510. FIG. 15 shows the primary support rails 1508 in cross-section, shown by the planar sides 1512. The structure 1500 is a representative portion of a larger suspended pixelated seating structure. The suspended pixelated seating structure 1500 also includes multiple tensile expansion members 1514 and multiple unaligned segments 1516 defined along the multiple primary support rails 1508. The multiple unaligned segments 1516 may alternatively be partially aligned, such as what aligning may incidentally result from aligning other portions of the multiple primary support rails 1508.

The multiple expansion control strands 1510 shown in FIG. 15 are linear, but may alternatively be non-linear. The multiple expansion control strands 1510 have an approximate thickness of 1.5 mm. This thickness may be varied according to a number of factors, including whether the multiple expansion control strands incorporate one or more non-linear segments.

The two sided tower springs 1504 include a top 1518, a deflectable member 1520 including two sides, and multiple spring attachment members 1522. The two sided tower springs 1504 may define an opening 1524 within the top 1518 for connection to the load support layer. The sides of the deflectable member 1520 include bottoms 1526 connected to the spring attachment members 1522. The sides of the deflectable member 1520 extend downwards from the top 1518 towards their respective bottoms 1526. The bottoms 1526 of the deflectable member 1520 curve upward and connect to the spring attachment members 1522. The spring attachment members 1522 are integrally molded to the unaligned segments 1516 on adjacent primary support rails 1508. Alternatively, the spring attachment members 1522 may connect to the unaligned segments 1516 with a snap fit connection or other connection method.

Figure 16:
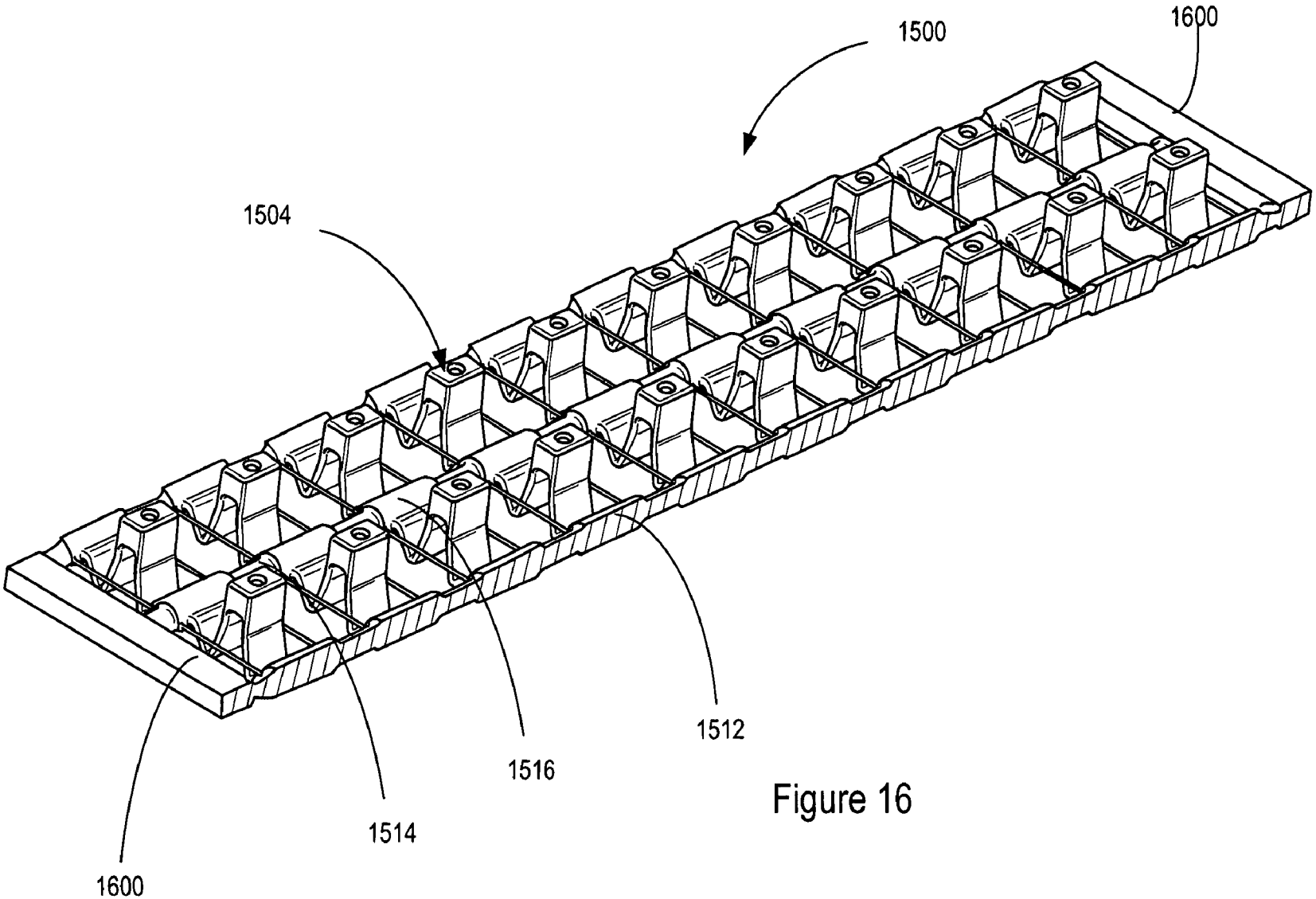
FIG. 16 shows a broader view of the portion of the suspended pixelated seating structure shown in FIG. 15.
Figure 17:
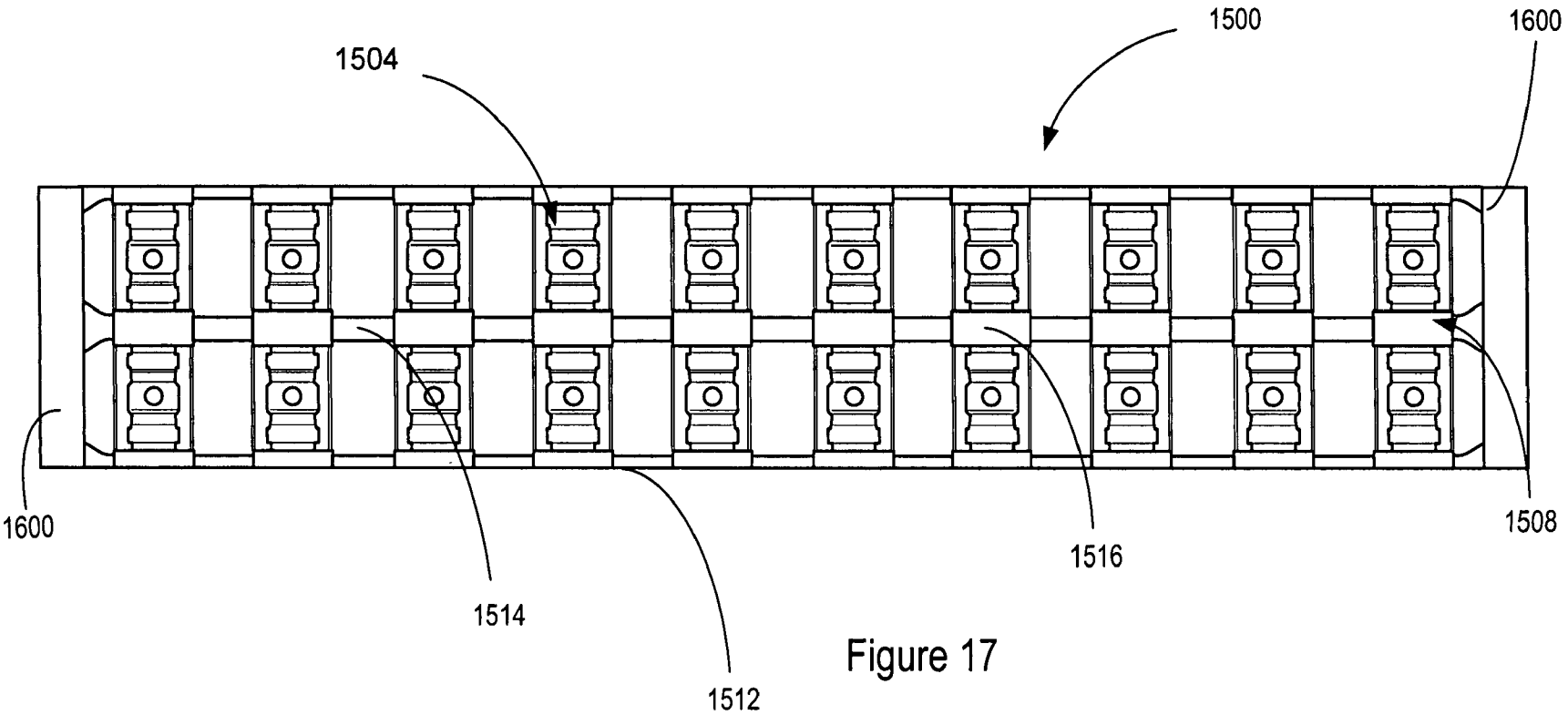
FIG. 17 shows a top view of the suspended pixelated seating structure shown in FIG. 16.
Figure 18:
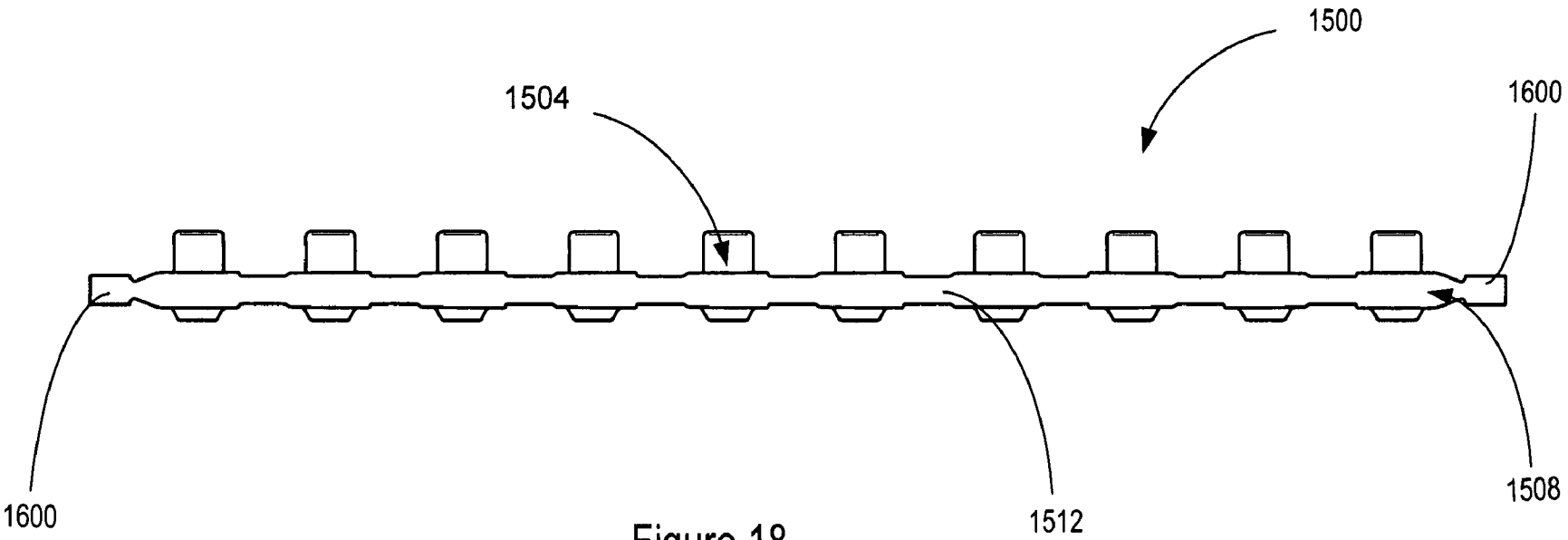
FIG. 18 shows a side view of the suspended pixelated seating structure shown in FIG. 16.

FIG. 16 shows a broader view of the portion of the suspended pixelated seating structure 1500 shown in FIG. 15. FIG. 16 shows the suspended pixelated seating structure 1500 further including support structure frame attachments 1600 positioned at opposite ends of the suspended pixelated seating structure 1500. FIGS. 17 and 18 respectively show a top view and a side view of the suspended pixelated seating structure 1500 shown in FIG. 16.

Figure 19:
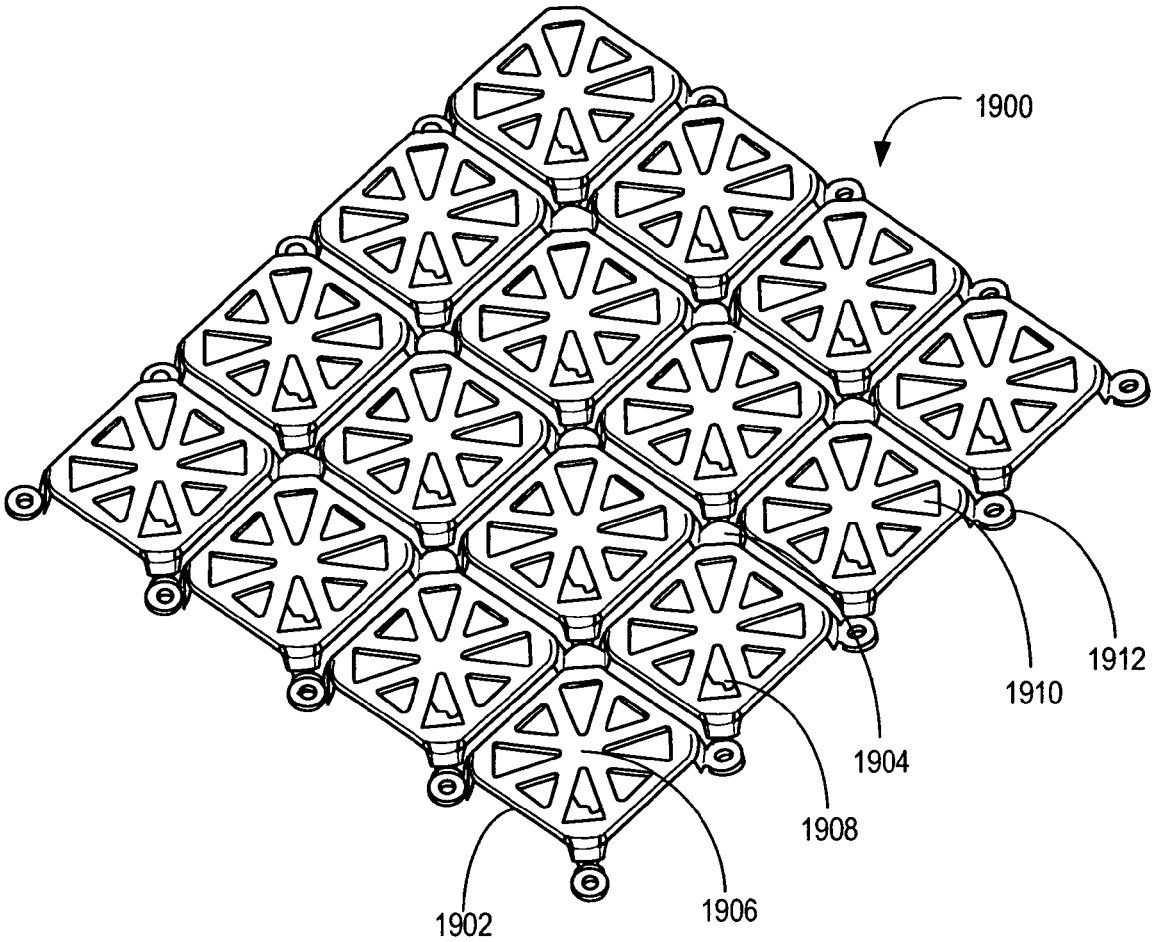
FIG. 19 shows a portion of a load support layer 1900 that may be used in a suspended pixelated seating structure.

FIG. 19 shows a portion of a load support layer 1900 that may be used in a suspended pixelated seating structure. The load support layer 1900 including multiple rectangular pixels 1902 interconnected at their corners with pixel connectors 1904. Each of the multiple pixels 1902 includes an upper surface 1906 and a lower surface. The multiple pixels 1902 are shown as rectangular, but may take other shapes, such as hexagons, octagons, triangles, or other shapes. The lower surface includes a stem 1908 extending from the lower surface for connection to the micro compliance layer. Each multiple pixel connector 1904 interconnects four pixels 1902 at their respective corners. As described below and shown in FIGS. 21-22, the multiple pixel connectors 1904 may alternatively interconnect the multiple pixels 1902 at their respective sides. As yet another alternative, the multiple pixels 1902 may be arranged in a brick pattern. In this alternative, the multiple pixel connectors 1904 may interconnect three pixels at the corner of two pixels and the side of a third pixel.

FIG. 19 shows the multiple pixel connectors 1904 as planar surfaces, recessed below the upper surface 1906 of the multiple pixels 1902. Alternatively, the multiple pixel connectors 1904 may be non-planar and/or contoured. The multiple pixels 1902 may also be positioned on even plane with the multiple pixels 1902.

The multiple pixels 1902 may define multiple openings 1910 within each pixel. The openings 1910 begin near the center of the pixel 1902 and gradually widen toward the edge of each pixel. The openings 1910 may add flexibility to load support layer 1900 in adapting to a load. FIG. 19 shows a load support layer 1900 including eight triangular openings 1910 defined within each pixel. The load support layer 1900, however, may define any number of openings 1910 within each pixel 1902, including zero or more openings 1910. Additionally, each pixel 1902 within the load support layer 1900 may define a different number of openings 1910 or different sized openings 1910, depending, for example, on the pixel's 1902 respective position within the load support layer 1900.

FIG. 19 shows circular connectors 1912, each defining an opening at its center, positioned at the outside corners of the outside pixels 1902. The circular connectors 1912 may provide anchor points for connecting the load support layer 1900 to the support structure. The circular connectors 1912 may be replaced by the multiple pixel connectors 1904 in other implementations.

Figure 20:
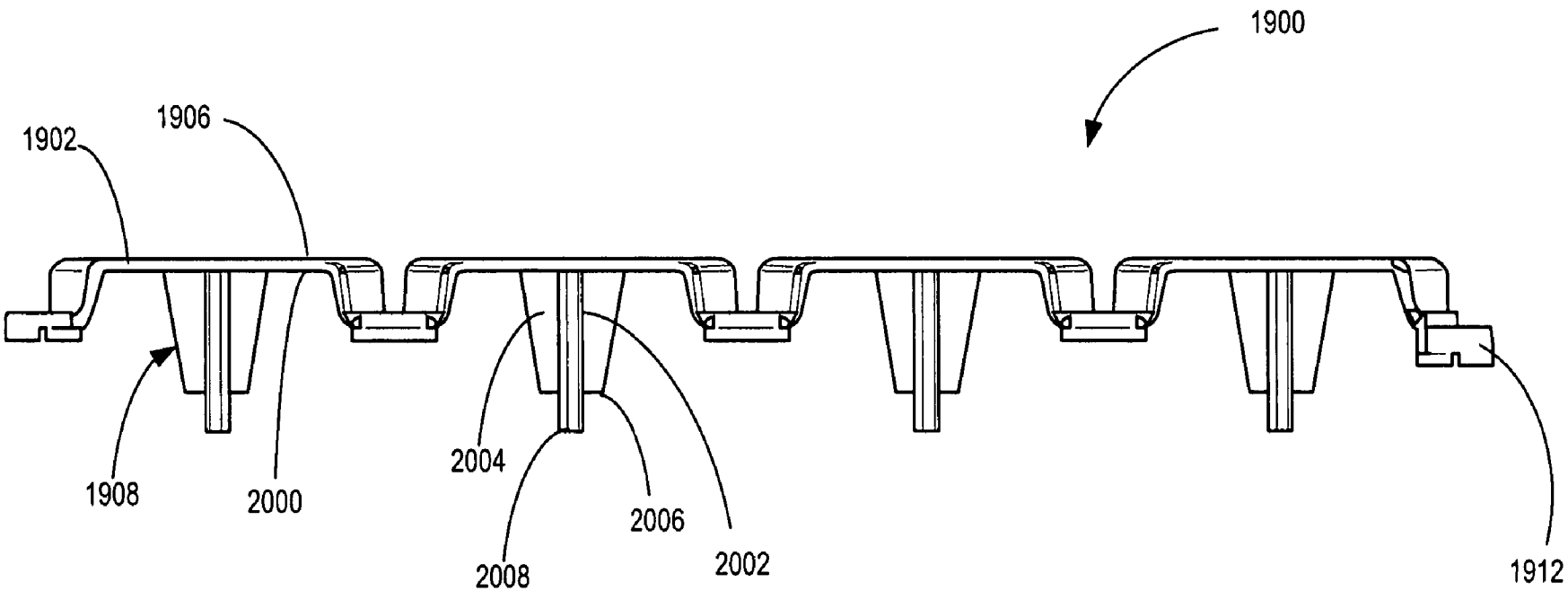
FIG. 20 shows a side view of the load support layer shown in FIG. 19.

FIG. 20 shows a side view of the load support layer 1900 shown in FIG. 19. FIG. 20 shows the upper and lower surfaces 1906 and 2000 of the multiple pixels 1902. As described above, the lower surface 2000 of each pixel 1902 may define or include a stem 1908 extending down toward the micro compliance layer. The stem 1908 includes a shaft 2002 and flaps 2004 extending outward from the shaft 2002 along the length of the shaft 2002. The flaps 2004 may include a cutoff bottom edge 2006 for abutment with the top of a corresponding spring element. For example, the portion 2008 of the shaft 2002 that extends beyond the cutoff bottom edge 2006 may insert into an opening defined within the top of the spring element until the cutoff bottom edge 2006 is flush with the top of the spring element. In this manner, when a load is applied to the load support layer 1900, the cutoff bottom edge 2006 presses down on the top of the spring element. The length of the shaft 2002, or whether a stem 1908 is included at all, may depend on the spring deflection level, as described above.

Figure 21:
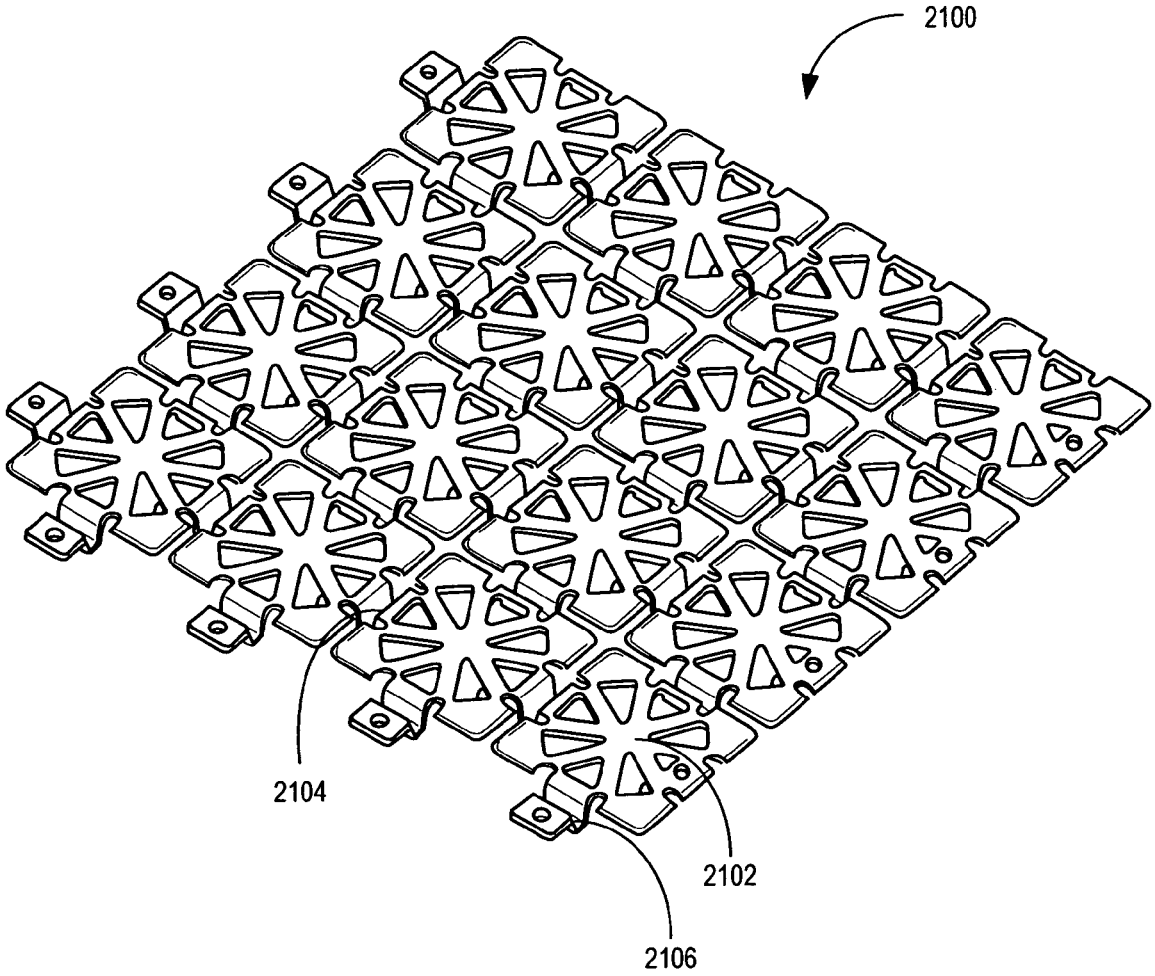
FIG. 21 shows a load support layer including multiple rectangular pixels interconnected at their sides via multiple pixel connectors.

FIG. 21 shows a load support layer 2100 including multiple rectangular pixels 2102 interconnected at their sides via pixel connectors 2104. The multiple pixel connectors 2104 include U-shaped bends 2106 to provide slack for each pixel's 2102 independent movement when a load is applied. Other shapes, such as an S-shape, or other undulating shape may be implemented for the pixel connectors 2104. The multiple pixel connectors 2104 may help reduce or prevent contact between adjacent pixels 2102 under deflection. The load support layer 2100 may alternatively omit the multiple pixel connectors 2104 to increase the independence of the multiple pixels 2102. While FIGS. 19 and 21 show load support layers 1900 and 2100 including rectangular pixels 1902 and 2102, a load support layer may alternatively include circular, triangular, or other shaped pixels. The multiple pixels 2102 may also include alternative arrangements, including a brick pattern, such as the brick pattern arrangement described above.

Figure 22:
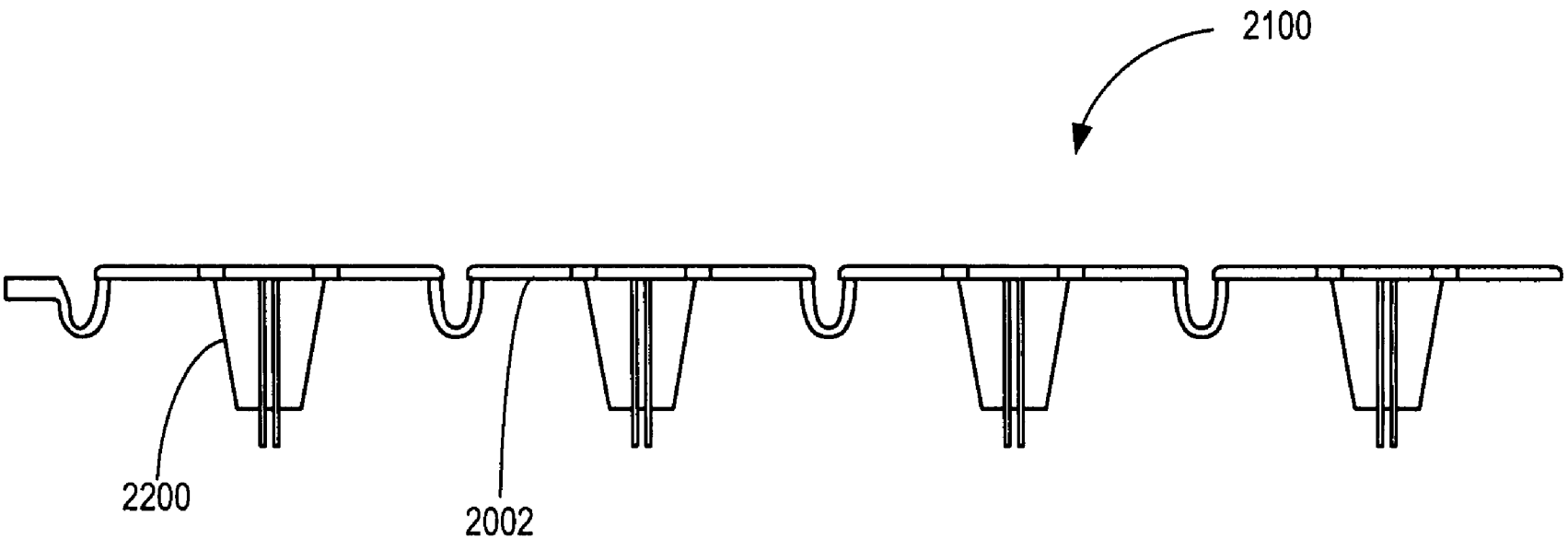
FIG. 22 shows a side view of the load support layer shown in FIG. 21.

FIG. 22 shows a side view of the load support layer 2100 shown in FIG. 21. FIG. 22 shows stems 2200 similar to the stems 1908 described above with reference to FIG. 20. Other stem types may be used as well. For example, the end of the stem 2200 may define an opening for receiving a stem extending upwards from the top of the spring element. As described above, a lower surface 2202 of the pixel may omit a stem 2200, but rather connect to the top of the spring element.

Figure 23:
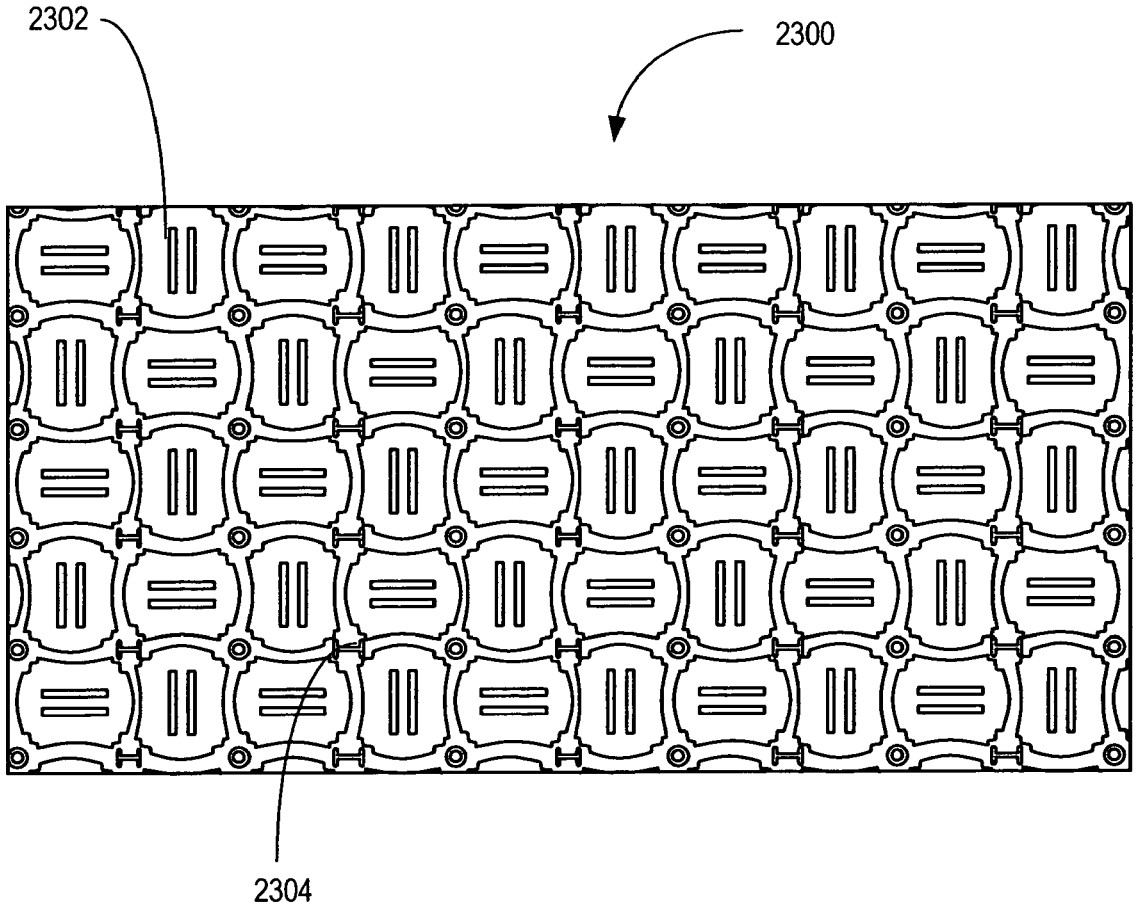
FIG. 23 shows a load support layer including multiple contoured pixels.
Figure 26:
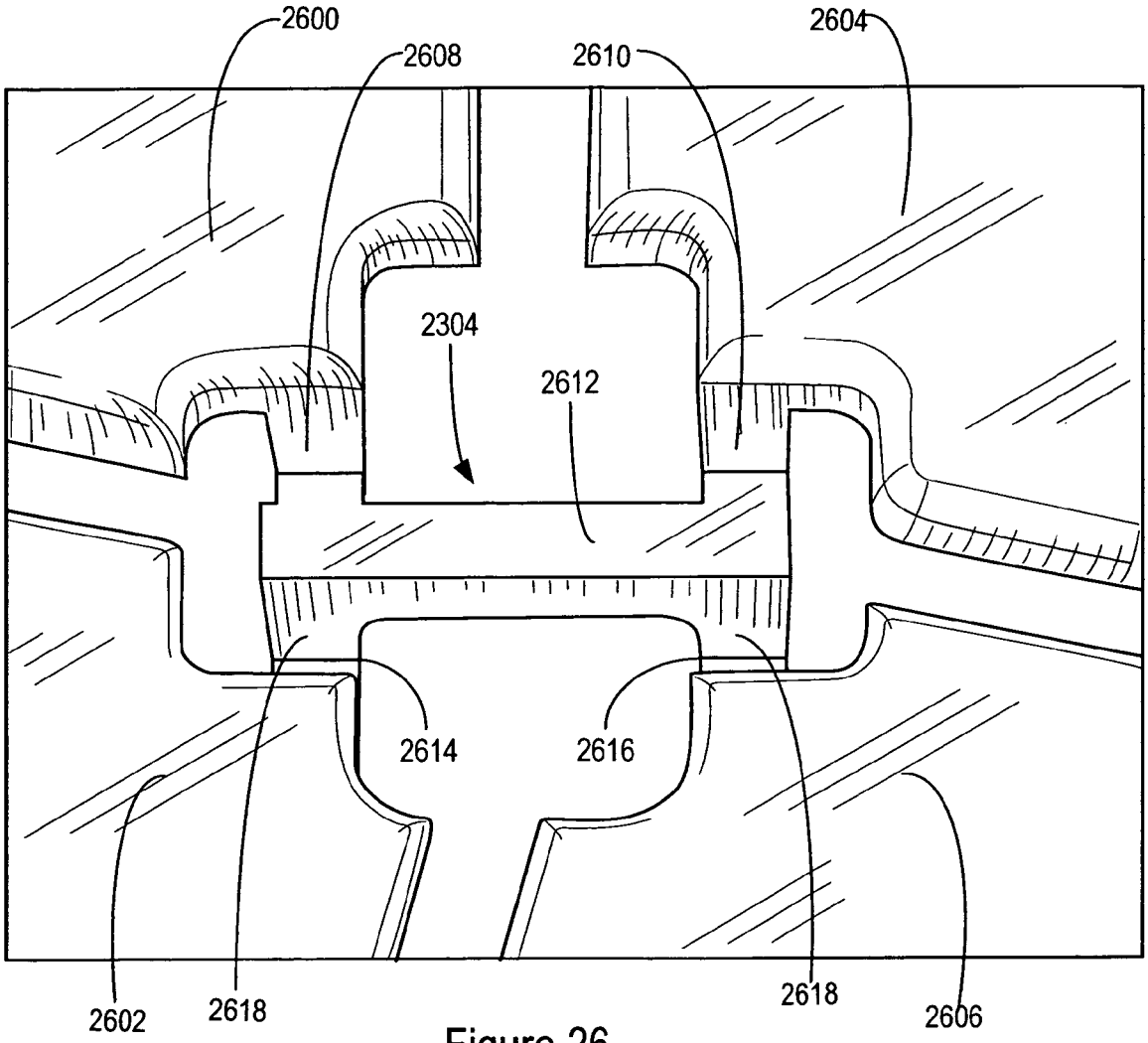
FIG. 26 shows a close up of one of the contoured pixels shown in FIGS. 23 and 24.

FIG. 23 shows a load support layer 2300 including multiple contoured pixels 2302. The load support layer 2300 also includes multiple bridged connectors 2304 to facilitate the connections between adjacent pixels 2302. In the example shown in FIG. 23, the bridged connectors 2304 are positioned at the corners of the pixels 2302, but may alternatively be located at the sides of the pixels 2302. The bridged connectors 2304 are described in more detail below and a close up of one bridge connector 2304 is shown in FIG. 26.

The contoured pixels 2302 may provide enhanced flexibility, aeration, and/or aesthetics to the load support layer 2300 and are described in more detail below and shown in FIG. 25. The contoured pixels 2302 may include stems, such as the stems 1908 and 2200 described above, for connecting to a micro compliance layer.

Figure 24:
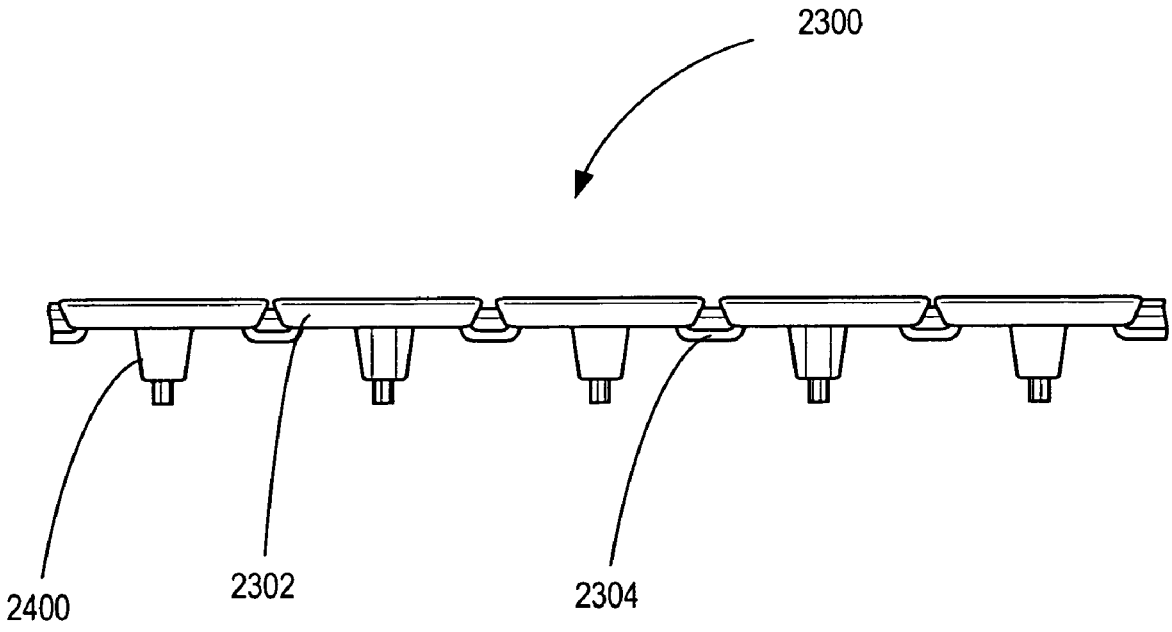
FIG. 24 shows an angled view of the load support layer shown in FIG. 23.

FIG. 24 shows a side view of the load support layer 2300 shown in FIG. 23. FIG. 24 shows the multiple contoured pixels 2302 including stems 2400 extending downward for connecting to a micro compliance layer.

Figure 25:
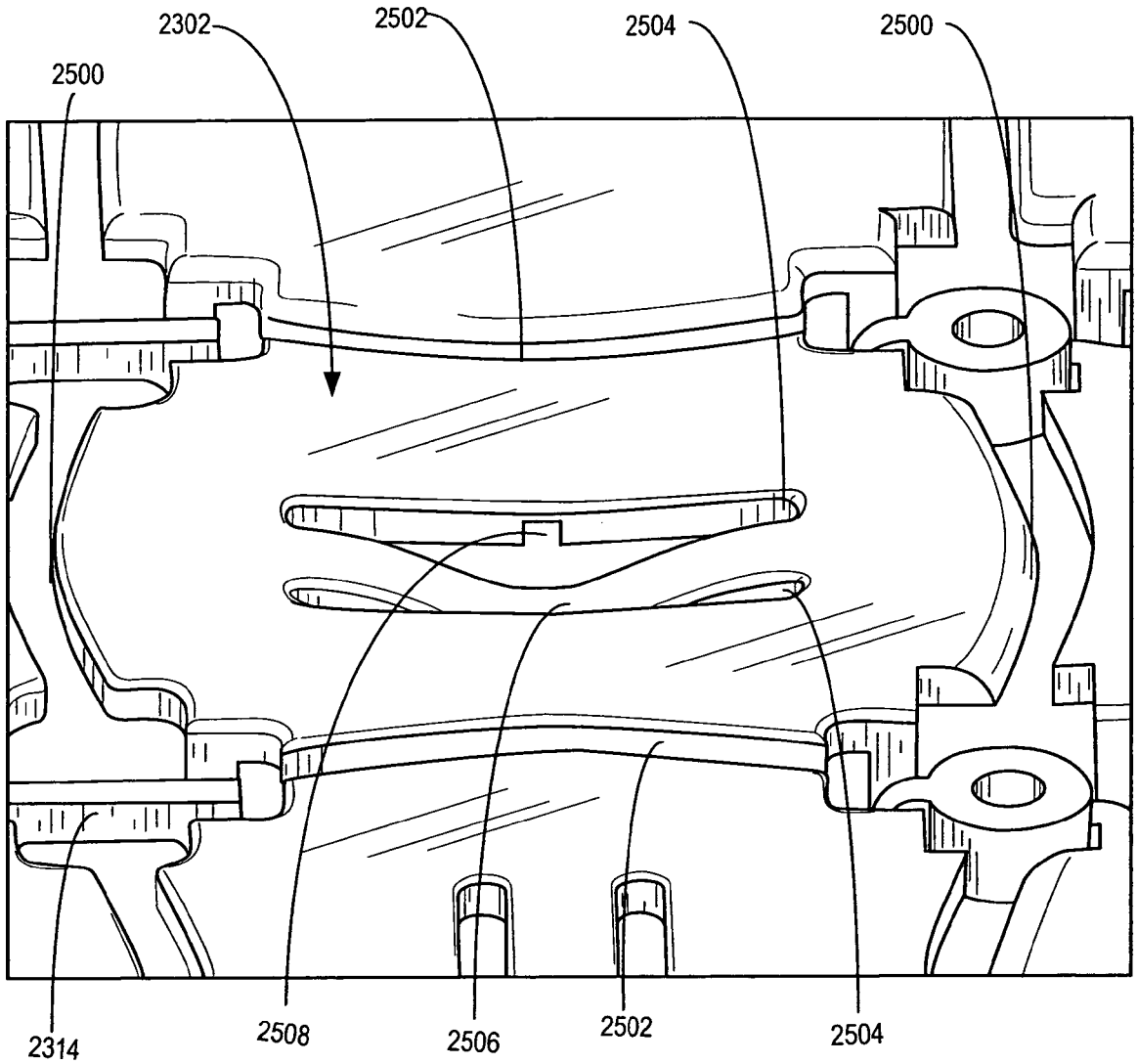
FIG. 25 shows a side view of the load support layer shown in FIGS. 23 and 24.

FIG. 25 shows a close up of one of the contoured pixels 2302 shown in FIG. 23. The contoured pixel 2302 includes a pair of convex shaped sides 2500 and a pair of concave shaped sides 2502. The contoured pixels 2302 are positioned such that every other pixel 2302 is rotated ninety degrees. In this manner the convex shaped sides 2500 of one pixel 2302 are adjacent to the concave shaped sides 2502 of an adjacent pixel 2302, and visa versa.

The contoured pixel 2302 may define multiple openings 2504 within the contoured pixel 2302 with a strip 2506 running between the openings 2504. The strip 2506 running between the openings 2504 provides added flexibility to the pixel. The strip 2506 may be a non-linear strip 2506 (e.g., an undulating, S-shaped, U-shaped, or other shape strip). In implementations in which the contoured pixel 2302 includes the stem 2400 for connecting to a micro compliance layer, the stem 2400 may connect to the center of the strip 2506 and extend downward toward the top of the corresponding spring element. The contoured pixel 2302 includes a hinge 2508 running perpendicular to the strip 2506 for enhanced compliance when a load is applied. The hinge 2508 may be defined by a cut-out portion of the lower surface of the contoured pixel 2302 to enhance the flexibility of the contoured pixel 2302.

FIG. 26 shows four pixels 2600-2606 connected via the bridged connector 2304 shown in FIG. 23. The bridged connector 2304 includes a left U-shaped connector 2608, a right U-shaped connector 2610, and a bridge strip 2612. The left and right U-shaped connectors 2608 and 2610 connect between the upper left and lower left pixels 2600 and 2602 and the upper right and lower right pixels 2604 and 2606 respectively. The left and right U-shaped connectors 2608 and 2610 bend downward, forming a left and a right U-shaped bend 2614 and 2616 respectively. The bridge strip 2612 includes cantilevered ends 2618. The cantilevered ends 2618 connect above the left and right U-shaped bends 2614 and 2616, forming a bridge between the two U-shaped bends 2614 and 2616. FIG. 26 shows a substantially linear bridge strip 2612. The bridge strip 2612 may alternatively be non-linear.

The bridged connectors 2304 provide an increased degree of independence as between adjacent pixels 2600-2606, as well as enhanced flexibility to the load support layer 2300. For example, the bridged connectors 2304 not only allow for flexible downward deflection, but also allow for individual pixels 2302 to independently move laterally in response to a load.

Figure 27:
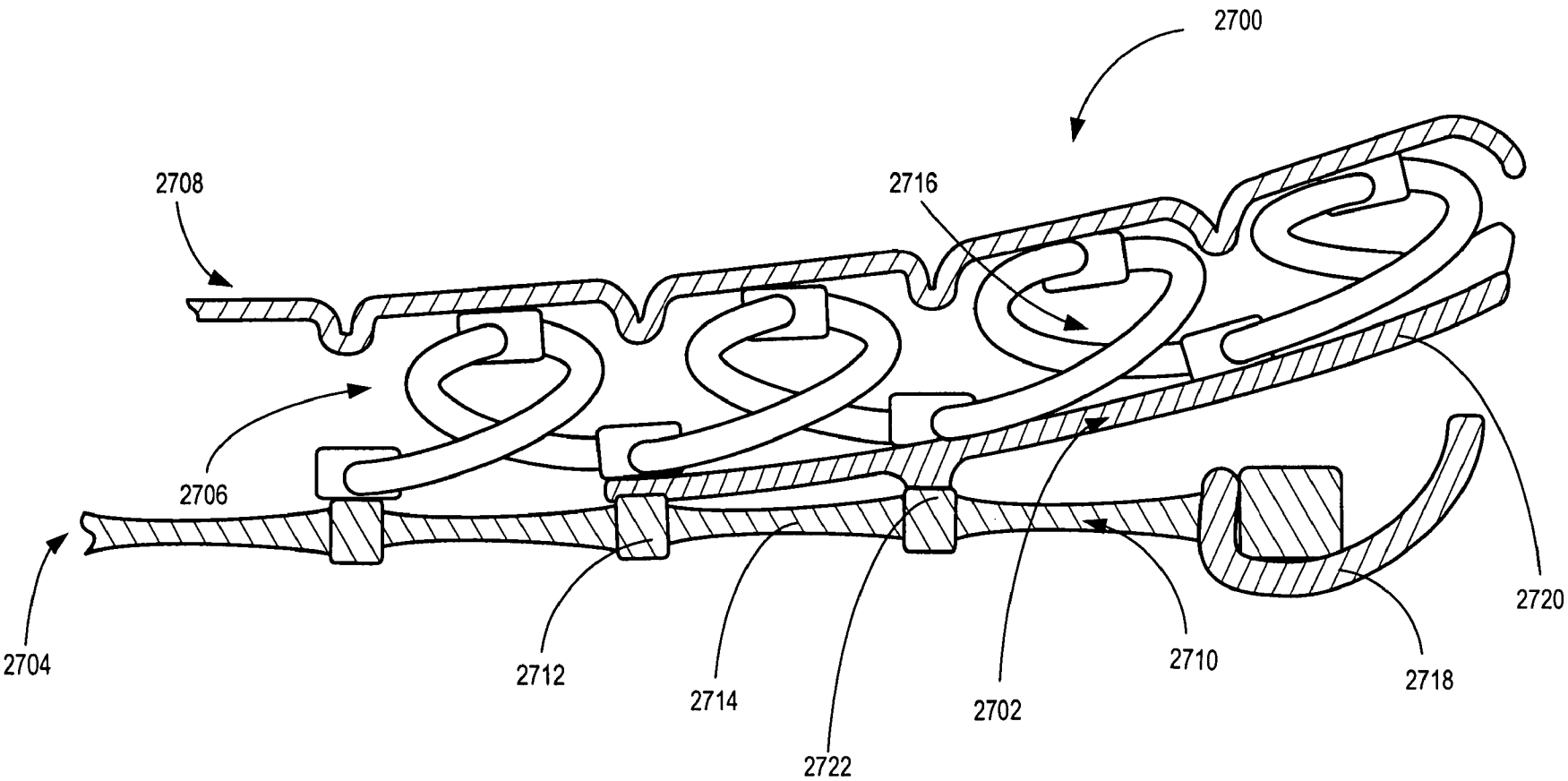
FIG. 27 shows a side view of a suspended pixelated seating structure including a bolstering member.

FIG. 27 shows a side view of a suspended pixelated seating structure 2700 including multiple bolstering support members 2702. The multiple bolstering support members 2702 may provide increase responsiveness to a load at the outer portions of the suspended pixelated seating structure 2700, such as at the portions of the suspended pixelated seating structure 2700 that connect to a support structure frame 2718. When a load is applied, the multiple bolstering support members 2702 may deflect downward, allowing for increased response to a load at the outer portions of the suspended pixelated seating structure 2700. In this manner, the bolstering support members 2702 may allow for increased comfort and support provided by the suspended pixelated seating structure 2700.

The suspended pixelated seating structure includes a macro compliance layer 2704, a micro compliance layer 2706, and a load support layer 2708. The macro compliance layer 2704 includes multiple primary support rails 2710, with multiple nodes 2712 and multiple tensile expansion members 2714 defined along the multiple primary support rails 2710. The micro compliance layer includes multiple spring elements 2716. FIG. 27 shows the suspended pixelated seating structure 2700 including multiple coil springs as the multiple spring elements 2716. The suspended pixelated seating structure 2700, however, may use other spring types, such as the spring types described above.

Each bolstering support member 2702 includes an angled pad 2720. Each bolstering support member 2702 may also include multiple connectors 2722 for connecting the bolstering support member 2702 to the macro and micro compliance layers 2704 and 2706. The connectors 2722 may include cantilevered elements, openings defined in the angled pad, or other elements for connecting the bolstering support members to the macro and micro compliance layers 2704 and 2706. While FIG. 27 shows only connectors 2722 for connecting the bolstering support member 2702 to the macro compliance layer 2704, other examples of the bolstering support member 2702 may include connectors 2722 for connecting the bolstering support member 2702 to the micro compliance layer 2706. Alternatively, the macro and micro compliance layers 2704 and 2706 may connect directly to the angled pad 2718. These connections may be a snap fit connection, an integral molding, or other connection method.

The bolstering support member is positioned between the outer portion of the macro compliance layer 2704 and the outer portion of the micro compliance layer 2706. For example, in FIG. 27, the bolstering support member 2702 is connected above the outer nodes 2712 of the multiple primary support rails 2710 via multiple connectors 2722, and connected below the spring elements 2716 positioned at the outer portion of the micro compliance layer 2706. The bolstering support member 2702 is positioned such that the angled pad 2720 angles upwards and outwards (relative to the macro compliance layer 2704) from the outer nodes 2712 to which the bolstering support member 2702 is connected. The degree of slope exhibited by the angled pad 2720 may be tuned according to the desired comfort and support characteristics of the suspended pixelated seating structure 2700.

The multiple spring elements 2716 may be connected along all or a portion the entire length of the upper surface of the angled pad 2720. The connection between the bolstering support member 2702 and the macro and micro compliance layers 2704 and 2706 may be an integral molding, a snap fit connection, or other connection method. In this manner, the angled pad 2720 may deflect downward when a load is applied, thus providing increased deflection at the outer portions of the suspended pixelated seating structure 2700.

While various embodiments of the invention have been described, it will be apparent to those of ordinary skill in the art that many more embodiments and implementations are possible within the scope of the invention. For example, the springs may be implemented as any resilient structure that recovers its original shape when released after being distorted, compressed, or deformed. Accordingly, the invention is not to be restricted except in light of the attached claims and their equivalents.

We claim:

1. A suspended pixelated seating structure comprising:

a macro compliance layer comprising:

a first support structure frame attachment;

a second support structure frame attachment, the first and second support structure frame attachments each comprising multiple frame connectors for connecting the macro compliance layer to a support structure frame;

multiple primary support rails extending substantially linearly between the first and second support structure frame attachments, where each of the multiple primary support rails are arranged substantially in parallel to each other of the multiple primary support rails;

multiple aligned regions discretely defined along the multiple primary support rails, where each of the multiple aligned regions comprise one of a compression aligned region or a tension aligned region; and multiple unaligned regions defined along the multiple primary support rails, where the unaligned regions separate adjacent aligned regions along a length of each of the multiple primary support rails, where the multiple primary support rails, multiple aligned and unaligned regions, first support structure frame attachment, and second support structure frame attachment comprise an elastomeric material and are integrally molded as a single unitary macro compliance layer;

a micro compliance layer above the macro compliance layer, the micro compliance layer comprising multiple spring elements, where each spring element is coupled to at least one unaligned region of the multiple primary support rails; and a load support layer supported by the micro compliance layer, the load support layer comprising multiple pixels positioned above and supported by the multiple spring elements.

2. The suspended pixelated seating structure of claim 1, further comprising a seat covering layer secured above the load support layer.

3. The suspended pixelated seating structure of claim 1, each primary support rail comprising multiple secondary supports extending out from the primary support rail.

4. The suspended pixelated seating structure of claim 1, the multiple pixels comprising multiple pixel connectors.

5. The suspended pixelated seating structure of claim 4, the multiple pixel connectors comprising multiple bridged connectors, the multiple bridged connectors comprising:

a first U-shaped bend connected between adjacent multiple pixels;

a second U-shaped bend connected between adjacent multiple pixels; and a strip connected between the first and the second U-shaped bends.

6. The suspended pixelated seating structure of claim 1, the multiple spring elements comprising:

a top; and a deflectable member, the deflectable member comprising multiple spiraled arms.

7. The suspended pixelated seating structure of claim 1, the multiple pixels defined as multiple contoured pixels.

8. The suspended pixelated seating structure of claim 1 further comprising multiple bolstering support members connected between the macro compliance layer and the micro compliance layer, each of the multiple bolstering support members comprising an angled pad.

9. The suspended pixelated seating structure of claim 1, the macro compliance layer comprising:

a first region pre-loaded by a first pre-load characteristic; and a second region pre-loaded by a second pre-load characteristic that is distinct from the first pre-load characteristic.

10. The suspended pixelated seating structure of claim 1, the macro compliance layer further comprising multiple strands, each extending between an unaligned region of a first primary support rail to an unaligned region of a second primary support rail that is adjacent to the first primary support rail.

11. The suspended pixelated seating structure of claim 1, where each unaligned region between adjacent aligned regions comprises a width that is wider than a width of either of the adjacent aligned regions.

12. The suspended pixelated seating structure of claim 1, where alternating aligned and unaligned regions form the multiple primary support rails.

13. The suspended pixilated seating structure of claim 1, where each of the multiple aligned regions comprises a tension aligned region.

14. The suspended pixilated seating structure of claim 1, where each of the multiple aligned regions comprises a compression aligned region.

15. A suspended pixelated seating structure comprising:

a macro compliance layer comprising:

a first support structure frame attachment;

a second support structure frame attachment;

multiple primary support rails extending substantially linearly between the first and second support structure frame attachments, where each of the multiple primary support rails are arranged substantially in parallel to each other of the multiple primary support rails; and multiple aligned regions discretely defined along the multiple primary support rails, where each of the multiple aligned regions comprise one of a compression aligned region or a tension aligned region; and multiple nodes defined along the multiple primary support rails between adjacent aligned regions;

a micro compliance layer supported by the primary support rails, the micro compliance layer comprising individually tuned springs defining a first regional response zone and a second regional response zone with different load support characteristics, where each individually tuned spring is coupled to at least one node of the primary support rails; and a load support layer supported by the micro compliance layer, the load support layer comprising interconnected individual pixels positioned above the individually tuned springs.

16. The suspended pixelated seating structure of claim 15, the macro compliance layer further comprising multiple secondary supports extending from the primary support rails, where micro compliance layer is further supported by the multiple secondary supports.

17. The suspended pixelated seating structure of claim 15, the individually tuned springs comprising:

a top; and a deflectable member connected to the top.

18. The suspended pixelated seating structure of claim 17, the deflectable member comprising at least one spiraled arm.

19. The suspended pixelated seating structure of claim 15, where the multiple primary support rails, multiple aligned regions, multiple nodes, first support structure frame attachment, and second support structure frame attachment are integrally molded from an elastomeric material as a single unitary macro compliance layer.

20. The suspended pixelated seating structure of claim 15, the macro compliance layer comprising:

a first region pre-loaded by a first pre-load characteristic; and a second region pre-loaded by a second pre-load characteristic that is distinct from the first pre-load characteristic.

21. The suspended pixelated seating structure of claim 15, the macro compliance layer further comprising multiple strands, each extending between a node of a first primary support rail to a node of a second primary support rail that is adjacent to the first primary support rail.

22. The suspended pixelated seating structure of claim 15, where the multiple nodes are unaligned regions defined between adjacent aligned regions.

23. The suspended pixelated seating structure of claim 15, where alternating aligned regions and nodes form the multiple primary support rails.

24. The suspended pixilated seating structure of claim 15, where each of the multiple aligned regions comprises a tension aligned region.

25. The suspended pixilated seating structure of claim 15, where each of the multiple aligned regions comprises a compression aligned region.

26. A suspended pixelated seating structure comprising:

a macro compliance layer comprising:

a first support structure frame attachment;

a second support structure frame attachment;

multiple primary support rails, extending substantially linearly between the first and second support structure frame attachments, where each of the multiple primary support rails are arranged substantially in parallel to each other of the multiple primary support rails;

multiple aligned regions discretely defined along the multiple primary support rails, where each of the multiple aligned regions comprise one of a compression aligned region or a tension aligned region; and multiple nodes defined along the multiple primary support rails between adjacent aligned regions;

a micro compliance layer above the macro compliance layer, the micro compliance layer comprising springs, where each spring is coupled to at least one node of the primary support rails; and a load support layer supported by the micro compliance layer, the load support layer comprising multiple pixels positioned above and supported by the multiple spring elements, where the pixels comprise:

stems extending downwardly to contact the springs;

openings in the pixels to facilitate pixel flexibility; and multiple pixel connectors for interconnecting the multiple pixels.

27. The suspended pixelated seating structure of claim 26, where the multiple primary support rails, multiple aligned regions, multiple nodes, first support structure frame attachment, and second support structure frame attachment are integrally molded from an elastomeric material as a single unitary macro compliance layer.

28. The suspended pixelated seating structure of claim 26, where each of the springs comprise at least one spiraled arm.

29. The suspended pixelated seating structure of claim 26, the macro compliance layer comprising:

a first region pre-loaded by a first pre-load characteristic; and a second region pre-loaded by a second pre-load characteristic that is distinct from the first pre-load characteristic.

30. The suspended pixelated seating structure of claim 26, the macro compliance layer further comprising multiple strands, each extending between a node of a first primary support rail to a node of a second primary support rail that is adjacent to the first primary support rail.

31. The suspended pixelated seating structure of claim 26, where the multiple nodes are unaligned regions defined between adjacent aligned regions.

32. The suspended pixelated seating structure of claim 26, where alternating aligned regions and nodes form the multiple primary support rails.

33. The suspended pixilated seating structure of claim 26, where each of the multiple aligned regions comprises a tension aligned region.

34. The suspended pixilated seating structure of claim 26, where each of the multiple aligned regions comprises a compression aligned region.

* * * * *